US011898755B2

(12) United States Patent
Ganiger et al.

(10) Patent No.: US 11,898,755 B2
(45) Date of Patent: Feb. 13, 2024

(54) COMBUSTOR WITH A VARIABLE VOLUME PRIMARY ZONE COMBUSTION CHAMBER

(71) Applicant: General Electric Company, Schenectady, NY (US)

(72) Inventors: Ravindra Shankar Ganiger, Bengaluru (IN); Hiranya Nath, Bengaluru (IN); Michael A. Benjamin, Cincinnati, OH (US); Nicholas R. Overman, Sharonville, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/805,983

(22) Filed: Jun. 8, 2022

(65) Prior Publication Data

US 2023/0400187 A1 Dec. 14, 2023

(51) Int. Cl.

| | |
|---|---|
| ***F23R 3/34*** | (2006.01) |
| ***F23R 3/26*** | (2006.01) |
| ***F23R 3/00*** | (2006.01) |

(52) U.S. Cl.

CPC ..... *F23R 3/346* (2013.01); *F23R 3/002* (2013.01); *F23R 3/26* (2013.01); *F23R 2900/00014* (2013.01); *F23R 2900/03044* (2013.01)

(58) Field of Classification Search

CPC .... F23R 3/002; F23R 3/02; F23R 3/26; F23R 3/34; F23R 3/60; F23R 2900/00013; F23R 2900/00014; F23R 2900/00015

See application file for complete search history.

(56) References Cited

U.S. PATENT DOCUMENTS

| | | | | |
|---|---|---|---|---|
| 4,567,724 A | | 2/1986 | Mongia et al. | |
| 4,594,848 A | * | 6/1986 | Mongia | F23R 3/26 60/39.23 |
| 4,702,073 A | | 10/1987 | Melconian | |
| 5,103,633 A | * | 4/1992 | Harshman | F23R 3/00 60/204 |
| 5,303,554 A | | 4/1994 | Faulkner | |
| 5,423,608 A | | 6/1995 | Chyou et al. | |
| 5,694,767 A | * | 12/1997 | Vdoviak | F02K 3/10 60/226.3 |

(Continued)

FOREIGN PATENT DOCUMENTS

| | | |
|---|---|---|
| EP | 1353127 B1 | 9/2010 |
| EP | 3486569 A1 | 5/2019 |

(Continued)

*Primary Examiner* — William H Rodriguez

(74) *Attorney, Agent, or Firm* — Venable LLP; Edward Kmett; Michele V. Frank

(57) ABSTRACT

A combustor for a gas turbine has a combustor liner including an outer liner and an inner liner, a combustion chamber being defined between the outer liner and the inner liner. The combustion chamber includes a primary combustion zone at an upstream end of the combustion chamber. The combustor also includes an outer liner expanded primary volume portion, and a secondary outer liner portion. One of the outer liner expanded primary volume portion and the secondary outer liner portion is movable to adjust a volume of the primary combustion zone by opening and closing access to the outer liner expanded primary volume portion so as to increase and to decrease the volume of the primary combustion zone.

20 Claims, 21 Drawing Sheets

(56) References Cited

U.S. PATENT DOCUMENTS

| | | | | |
|---|---|---|---|---|
| 6,572,366 | B2 | 6/2003 | Eroglu et al. | |
| 7,500,347 | B2 | 3/2009 | Sanders et al. | |
| 8,484,980 | B1 | 7/2013 | Trefny et al. | |
| 8,727,070 | B2 * | 5/2014 | Huber | F23M 20/005 123/184.55 |
| 8,966,877 | B2 | 3/2015 | McKinney | |
| 9,546,598 | B2 | 1/2017 | Ostebee et al. | |
| 9,689,572 | B2 | 6/2017 | Johnson et al. | |
| 9,970,659 | B2 * | 5/2018 | Schuermans | F23R 3/04 |
| 10,422,283 | B2 | 9/2019 | Yang et al. | |
| 10,920,985 | B2 | 2/2021 | Gao et al. | |
| 11,668,462 | B1 * | 6/2023 | Benjamin | F23R 3/50 60/752 |
| 2004/0248053 | A1 * | 12/2004 | Benz | F23R 3/002 431/114 |
| 2005/0034444 | A1 * | 2/2005 | Sanders | F23N 1/022 60/39.23 |
| 2011/0308630 | A1 * | 12/2011 | Huber | F23M 20/005 137/494 |
| 2012/0102963 | A1 * | 5/2012 | Corr | F23R 3/002 60/725 |
| 2013/0025282 | A1 * | 1/2013 | Bulat | F23R 3/002 60/725 |
| 2014/0216038 | A1 | 8/2014 | Keener et al. | |
| 2015/0020498 | A1 * | 1/2015 | Schilp | F01D 9/023 60/39.83 |
| 2015/0047357 | A1 * | 2/2015 | Schuermans | F23R 3/04 60/725 |
| 2016/0053721 | A1 * | 2/2016 | Fletcher | F02C 9/18 60/226.3 |
| 2016/0153661 | A1 * | 6/2016 | Bothien | F23R 3/002 60/725 |
| 2018/0010797 | A1 * | 1/2018 | Marusko | F23R 3/007 |
| 2020/0271317 | A1 | 8/2020 | Simmons et al. | |
| 2023/0250961 | A1 * | 8/2023 | Ganiger | F23R 3/06 60/752 |

FOREIGN PATENT DOCUMENTS

| | | |
|---|---|---|
| EP | 2357412 B1 | 9/2019 |
| EP | 2725303 B1 | 8/2020 |

* cited by examiner

COMBUSTOR WITH A VARIABLE VOLUME PRIMARY ZONE COMBUSTION CHAMBER

TECHNICAL FIELD

The present disclosure relates to a combustion chamber in a gas turbine. More particularly, the present disclosure relates to a combustor that has a liner that provides for a variable volume primary combustion zone.

BACKGROUND

In conventional gas turbine engines, a combustor liner is provided to define a combustion chamber. The combustion chamber generally defines a primary combustion zone at a forward end of the combustion chamber nearest to a fuel nozzle and a mixer assembly that injects a fuel and air mixture into the combustion chamber, where the fuel and air mixture is ignited and burned to form combustion gases. The combustion chamber may also include a dilution zone downstream of the primary combustion zone, where dilution air is provided through the combustor liner to quench the combustion gases. The combustion chamber may further include a secondary combustion zone where the quenched combustion gases further mix with the dilution air before flowing through a turbine nozzle into a turbine section of the gas turbine engine. Typically, the combustor liner has a fixed length and a geometry such that the various zones of the combustion chamber (e.g., a primary zone, a dilution zone, and a secondary zone) have a fixed volume for operating through all of the various operating states, such as startup, takeoff, cruise, and approach.

BRIEF DESCRIPTION OF THE DRAWINGS

Features, advantages, and embodiments of the present disclosure will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Various features, advantages, and embodiments of the present disclosure are set forth or apparent from a consideration of the following detailed description, drawings, and claims. Moreover, it is to be understood that the following detailed description is exemplary and intended to provide further explanation without limiting the scope of the disclosure as claimed.

In conventional gas turbine engines, the combustor liner has a fixed volume and a geometry such that various zones of the combustion chamber (e.g., a primary zone, a dilution zone, and a secondary zone) have a fixed volume for operating through all of the various operating states of the engine. However, due to ever more stringent emission requirements for gas turbine engines, there is a need to continue to reduce NOx emissions and to obtain a more efficient burn of the fuel and air mixture. The present disclosure aims to reduce the NOx emissions and to improve operability by varying the volume of the primary combustion zone throughout the various operating states. According to the present disclosure, a combustor liner includes an outer liner expanded primary volume portion, and a secondary outer liner portion. One of the outer liner expanded primary volume portion and the secondary outer liner portion is movable to adjust a volume of the primary combustion zone by opening and closing access to the outer liner expanded primary volume portion so as to increase and to decrease the volume of the primary combustion zone. Thus, a smaller primary combustion zone can be provided for during high power operations so as to provide for a more efficient burn of the fuel and air mixture in the primary combustion zone. On the other hand, by increasing the volume of the primary combustion zone by actuating the secondary liner portion to allow access to the outer liner expanded primary volume portion and to increase the primary combustion zone accordingly, operability can be improved during the lower power operations.

Figure 1:
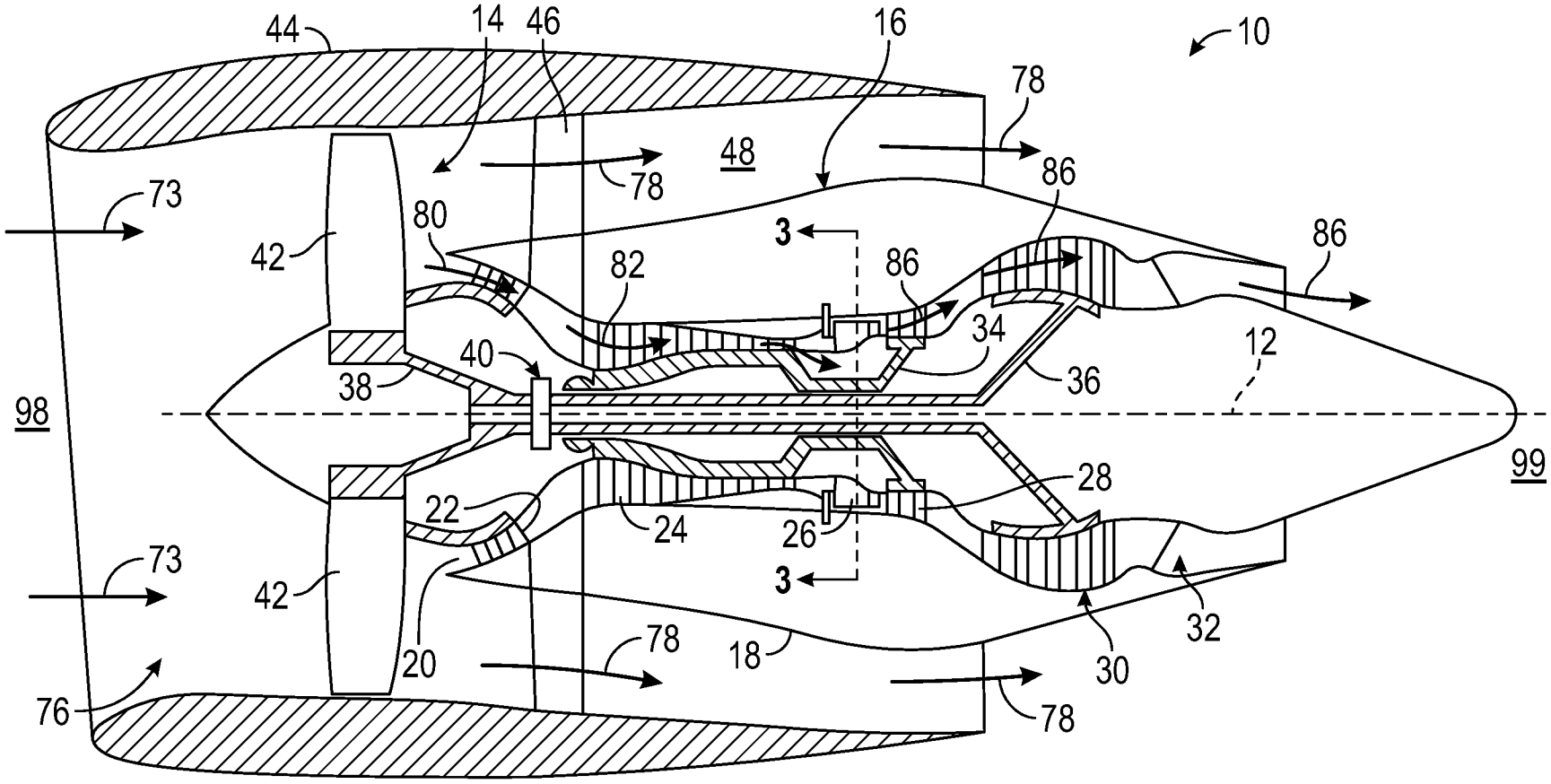
FIG. 1 is a schematic partial cross-sectional side view of an exemplary high by-pass turbofan jet engine, according to an embodiment of the present disclosure.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has an axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section (22/24) having a booster or a low pressure (LP) compressor 22 and a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive configuration or a geared-drive configuration.

As shown in FIG. 1, the fan assembly 14 includes a plurality of fan blades 42 that are coupled to, and that extend radially outwardly from, the fan shaft 38. An annular fan casing, or a nacelle 44, circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16, so as to define a bypass airflow passage 48 therebetween.

Figure 2:
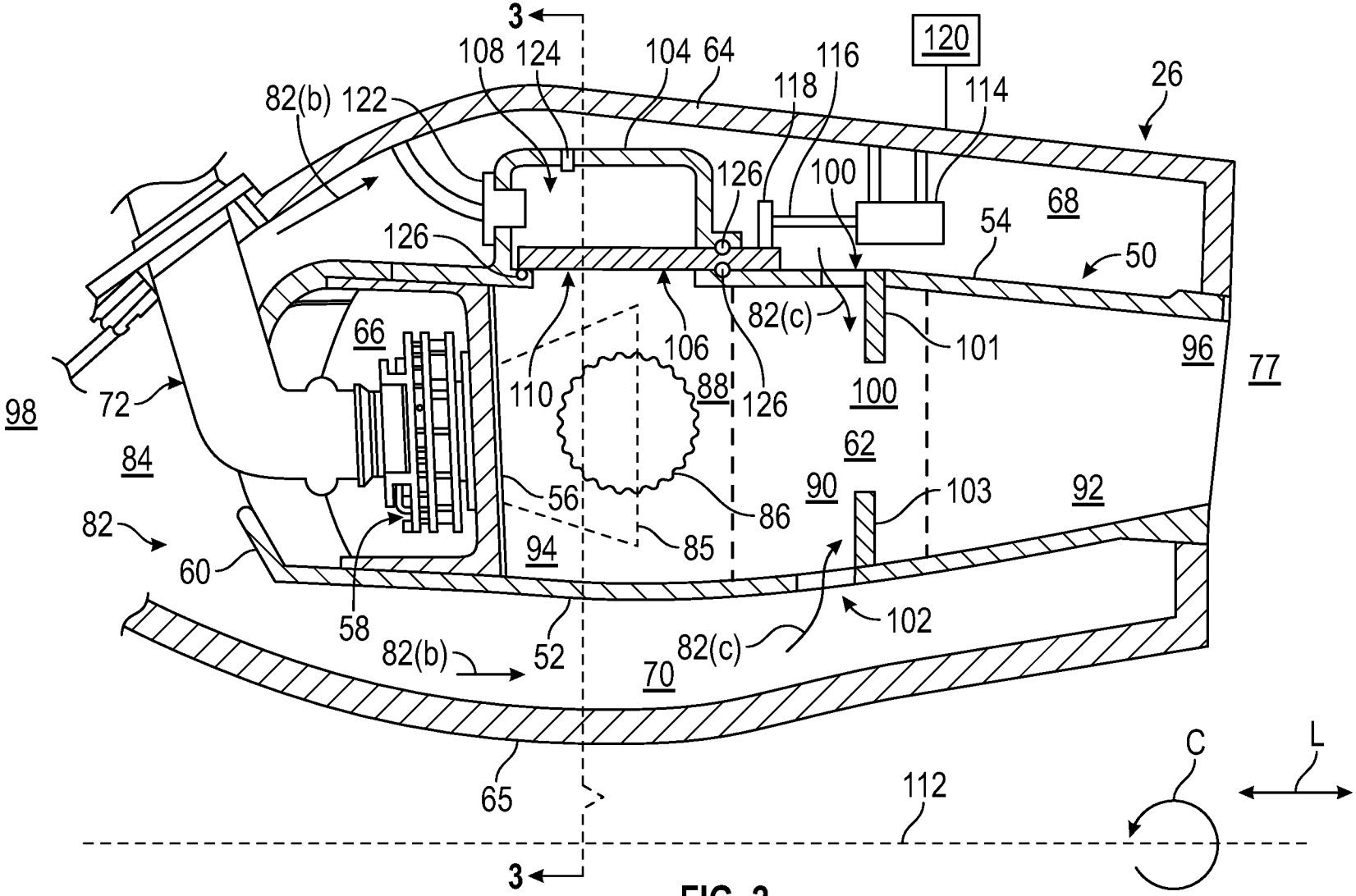
FIG. 2 is a cross-sectional side view of a combustor, according to an embodiment of the present disclosure.

FIG. 2 is a cross-sectional side view of an exemplary combustor 26 of the core engine 16 as shown in FIG. 1. As shown in FIG. 2, the combustor 26 may generally include an annular type combustor liner 50 that extends circumferentially about a combustor centerline axis 112, and includes an inner liner 52 and an outer liner 54, and a dome assembly 56. The inner liner 52, the outer liner 54, and the dome assembly 56 extend circumferentially about the combustor centerline axis 112. Together, the inner liner 52, the outer liner 54, and the dome assembly 56 define a combustion chamber 62 therebetween. The combustion chamber 62 may more specifically define various regions, including a primary combustion zone 88 at an upstream end 94 of the combustion chamber 62, at which initial chemical reaction of a fuel-oxidizer mixture 85 and/or recirculation of combustion gases 86 may occur before flowing further downstream to a dilution zone 90, where mixture and/or recirculation of the combustion gases 86 and dilution air may occur before flowing to a secondary combustion zone 92 at a downstream end 96 of the combustion chamber 62, where the combustion products flow into a turbine nozzle 77. The dome assembly 56 extends radially between the outer liner 54 and the inner liner 52, and, as was described above, extends circumferentially about the combustor centerline axis 112. In addition, the inner liner 52, the outer liner 54, and the dome assembly 56 are connected to a cowl 60, and the cowl 60 defines a pressure plenum 66 between the cowl 60 and the dome assembly 56.

As shown in FIG. 2, the outer liner 54 may be encased within an outer casing 64 and the inner liner 52 may be encased within an inner casing 65. An outer flow passage 68 is defined between the outer casing 64 and the outer liner 54, and an inner flow passage 70 is defined between the inner casing 65 and the inner liner 52. The outer liner 54 and the inner liner 52, therefore, at least partially define a hot gas path between the combustor liner 50 and the turbine nozzle 77.

As further seen in FIG. 2, the inner liner 52 may include a plurality of dilution openings 102 and an inner liner dilution fence 103 in the dilution zone 90, and the outer liner 54 may include a plurality of dilution openings 100 and a dilution fence 101 in the dilution zone 90. The dilution openings 100, the dilution fence 101, the dilution openings 102, and the inner liner dilution fence 103 provide a flow of dilution air 82(*c*) therethrough from the outer flow passage 68 and from the inner flow passage 70 and into the combustion chamber 62. The flow of dilution air 82(*c*) can be utilized to provide quenching of the combustion gases 86 in the dilution zone 90 downstream of the primary combustion zone 88 so as to cool the flow of combustion gases 86 entering the turbine nozzle 77.

During operation of the engine 10, as shown in FIGS. 1 and 2 collectively, a volume of air 73, as indicated schematically by arrows, enters the engine 10 from the upstream end 98 through an associated inlet 76 of the nacelle 44 and/or a fan assembly 14. As the volume of air 73 passes across the fan blades 42, a portion of the air 73, as indicated schematically by arrows 78, is directed or routed into a bypass airflow passage 48, while another portion of the air 73, as indicated schematically by an arrow 80, is directed or routed into the LP compressor 22 via the annular inlet 20. Air portion 80 entering the annular inlet 20 is progressively compressed as it flows through the LP compressor 22 and the HP compressor 24 towards the combustor 26. As shown in FIG. 2, the now compressed air, as indicated schematically by arrow 82, flows into a diffuser cavity 84 of the combustor 26 and pressurizes the diffuser cavity 84. A first portion of the compressed air 82, as indicated schematically by arrows 82(*a*), flows from the diffuser cavity 84 into the pressure plenum 66. The compressed air 82(*a*) is then swirled by a mixer assembly 58 and mixed with fuel provided by a primary fuel nozzle 72 to generate the fuel-oxidizer mixture 85 that is then ignited and burned to generate the combustion gases 86 within the primary combustion zone 88 of the combustion chamber 62. Typically, the LP compressor 22 and the HP compressor 24 provide more compressed air 82 to the diffuser cavity 84 than is needed for combustion. Therefore, a second portion of the compressed air 82, as indicated schematically by arrows 82(*b*), may be used for various purposes other than combustion. For example, as shown in FIG. 2, compressed air 82(*b*) may be routed into the outer flow passage 68 and into the inner flow passage 69. A portion of the compressed air 82(*b*) may then be routed through the dilution openings 100 (schematically shown as compressed air 82(*c*)) and into the dilution zone 90 of the combustion chamber 62 to provide quenching of the combustion gases 86 in the dilution zone 90. A similar flow of the compressed air 82(*c*) from the inner flow passage 70 flows through the dilution openings 102 and into the dilution zone 90. In addition, or in the alternative, at least a portion of compressed air 82(*b*) may be routed out of the diffuser cavity 84 and may be directed through various flow passages (not shown) to provide cooling air to at least one of the HP turbine 28 or the LP turbine 30.

Referring back to FIGS. 1 and 2 collectively, the combustion gases 86 generated in the combustion chamber 62 flow from the combustor liner 50 into the HP turbine 28 via the turbine nozzle 77, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at the downstream end 99.

Various arrangements of the combustor 26 according to the present disclosure will now be described. Generally, each combustor 26 according to the present disclosure includes the ability to expand the volume of the primary combustion zone 88.

Referring to FIG. 2, the combustor 26 includes an outer liner expanded primary volume portion 104, and a secondary outer liner portion 106. The outer liner expanded primary volume portion 104 of FIG. 2 may be made of metal, ceramic matrix composite, or other materials, and may be integral with the outer liner 54 and defines an expanded primary combustion zone cavity 108 therewithin. As used herein, the term "integral" may mean that one member is formed as a continuous part of another member, or it may mean that one member is connected to (e.g., bonded to, brazed to, etc.) another member so as to define a single component part. In addition, a member that is deemed to be "integral" with another member is taken to mean that the member is not translatable, rotatable, or movable with respect to another member that may be translatable, rotatable, or movable. The secondary outer liner portion 106 may also be made of metal, ceramic matrix composite, or other materials.

Figure 3:
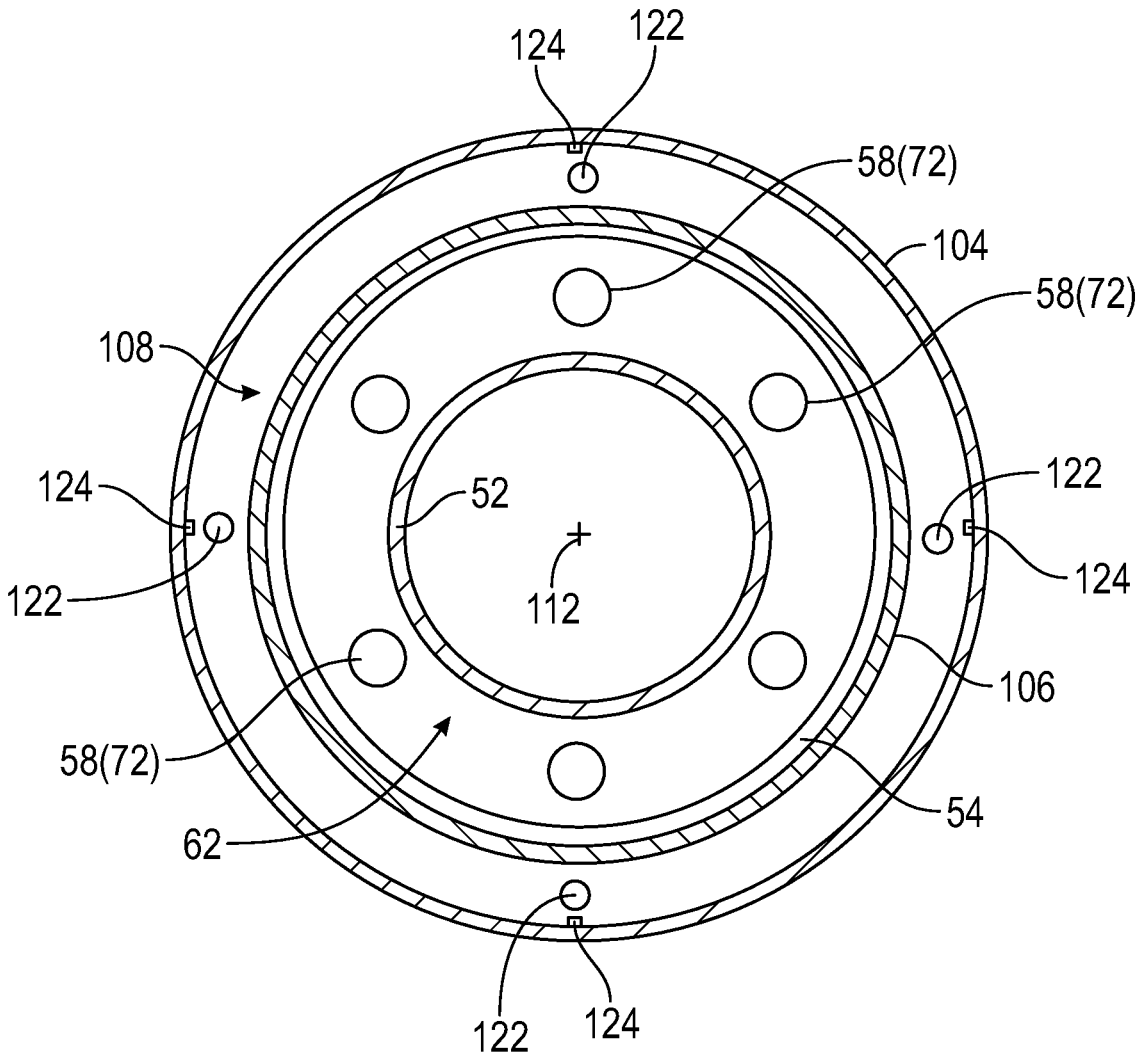
FIG. 3 is a cross-sectional view of a combustor liner taken at plane 3-3 of FIG. 2, according to an aspect of the present disclosure.

FIG. 3 is a cross-sectional view of the combustor liner 50 taken at plane 3-3 of FIG. 2. The outer liner expanded primary volume portion 104 and the secondary outer liner portion 106 extend circumferentially about the combustor centerline axis 112 such that the expanded primary combustion zone cavity 108 also extends circumferentially about the combustor centerline axis 112. The expanded primary combustion zone cavity 108 may expand the total volume of the primary combustion zone 88 by as much as up to forty percent.

Referring back to FIG. 2, the secondary outer liner portion 106 also extends in a longitudinal direction (L) across an inner side 110 of the outer liner expanded primary volume portion 104. In one aspect, the secondary outer liner portion 106 may include or function as an acoustic damper when in the closed position. A plurality of seals 126 may be included between the outer liner expanded primary volume portion 104 and the secondary outer liner portion 106. The secondary outer liner portion 106 is longitudinally movable to adjust the total volume of the primary combustion zone 88 by opening and closing access to the outer liner expanded primary volume portion 104. More specifically, the secondary outer liner portion 106 may be actuated in the longitudinal direction (L) via one or more actuators 114 so as to open and to close access to the outer liner expanded primary volume portion 104. The actuator 114 may be, for example, a pneumatic actuator or a hydraulic actuator that is controlled by an engine controller 120 that controls the engine 10. The actuator 114 may include an actuator arm 116 that is connected to the secondary outer liner portion 106 via a connecting linkage 118, and the actuator arm 116 may be extended and retracted by the actuator 114 so as to longitudinally translate the secondary outer liner portion 106 to open and to close access to the outer liner expanded primary volume portion 104. Thus, for example, at various operating conditions of the engine 10, the engine controller 120 may actuate the actuator 114 so as to open access to the outer liner expanded primary volume portion 104, thereby expanding the total volume of primary combustion zone 88. At other operating conditions of the engine 10, the engine controller 120 may actuate the actuator 114 so as to close access to the outer liner expanded primary volume portion 104. By adjusting the volume of the primary combustion zone 88, NOx emissions can be reduced and a more efficient operation of the combustor 26 can be achieved.

Referring to FIGS. 2 and 3 collectively, at least one secondary fuel nozzle 122 and a secondary ignitor 124 may be provided within the outer liner expanded primary volume portion 104. The secondary fuel nozzle 122 and the secondary ignitor 124 may be made operational by the engine controller 120 during, for example, starting and/or higher power operating conditions where the volume of the primary combustion zone 88 may be expanded by the secondary outer liner portion 106 being actuated to open access to the outer liner expanded primary volume portion 104.

Figure 4:
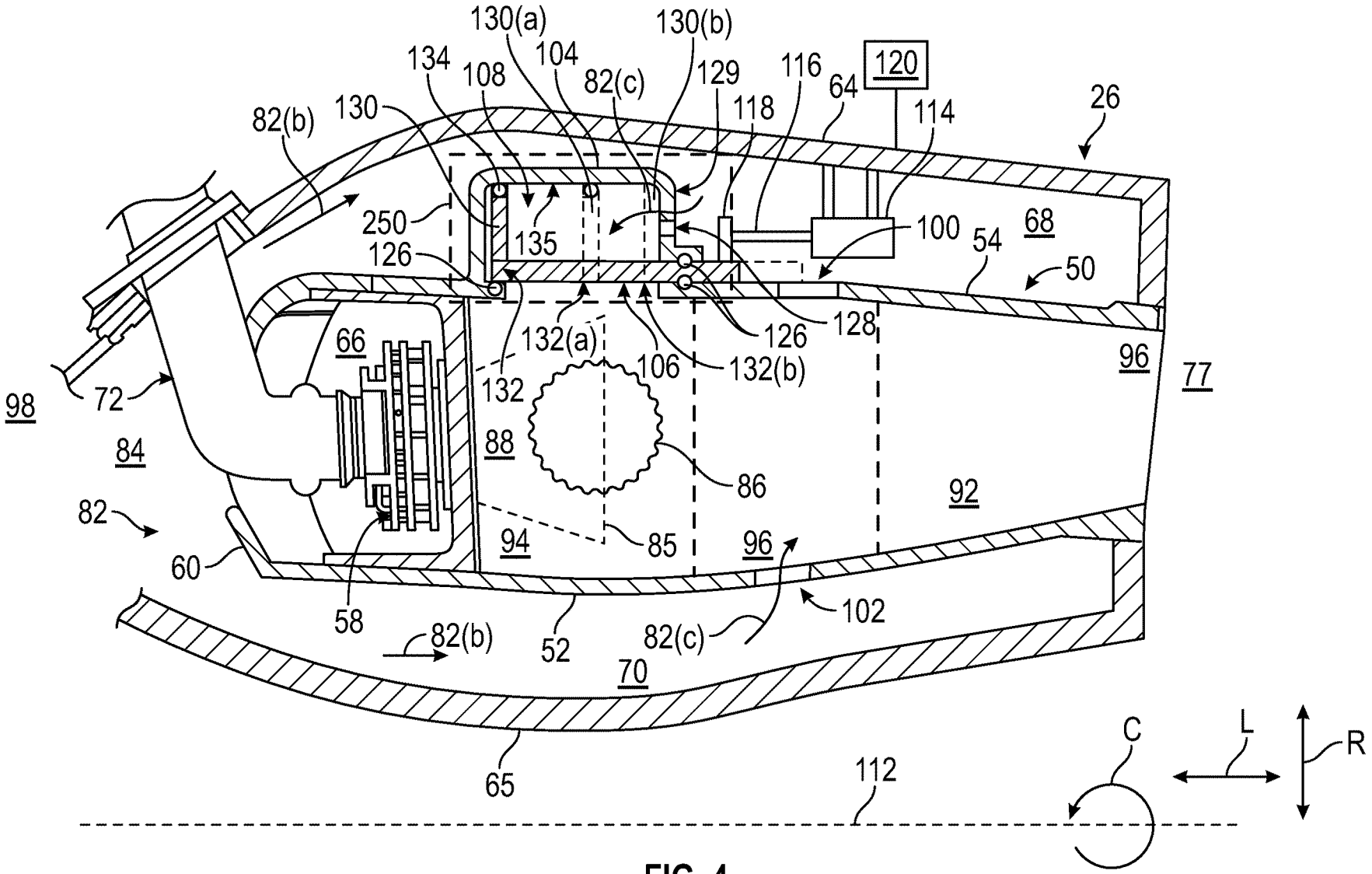
FIG. 4 is a cross-sectional side view of a combustor, according to another aspect of the present disclosure.

FIG. 4 is a cross-sectional side view of an exemplary combustor 26, according to another aspect of the present disclosure. The FIG. 4 aspect is similar to the FIG. 2 aspect. In FIG. 4, however, the outer liner expanded primary volume portion 104 includes at least one cooling airflow opening 128 on a downstream side 129 of the outer liner expanded primary volume portion 104. In addition, an upstream end 132 of the secondary outer liner portion 106 includes an upstream wall 130 extending radially outward in a radial direction (R) with respect to the combustor centerline axis 112. The upstream wall 130 also extends circumferentially about the combustor centerline axis 112. A seal 134 may be provided between the upstream wall 130 and an inner surface 135 of the outer liner expanded primary volume portion 104. At least one cooling airflow opening 128 provides a flow of cooling air 82(*c*) into the primary combustion zone cavity 108 between the outer liner expanded primary volume portion 104, and the secondary outer liner portion 106 to provide impingement cooling to the secondary outer liner portion 106. When the secondary outer liner portion 106 is translated fully in the longitudinal direction (L) toward the downstream end 96 of the combustion chamber 62, the upstream wall 130 may engage the cooling airflow openings 128 so as to restrict the flow of air 82(*c*) through the cooling airflow openings 128.

In addition, with the inclusion of the upstream wall 130 at the upstream end 132 of the secondary outer liner portion 106, the secondary outer liner portion 106 can be actuated in the longitudinal direction (L) so that the upstream wall 130 progressively adjusts the volume of the primary combustion zone 88 to progressively increase the volume of the primary combustion zone 88, or to progressively decrease the volume of the primary combustion zone 88. That is, the secondary outer liner portion 106 may be actuated in toward the downstream end 96 (i.e., in a downstream direction) by the actuator 114 from the fully closed position shown in FIG. 4 to a partially open position, where the upstream wall 130 may be located at the position shown as the upstream wall 130(*a*), to a fully open position, where the upstream wall 130 may be located at a position 130(*b*). When the upstream wall 130 is at the fully open position 130(*b*), the upstream wall 130 closes the cooling airflow opening 128. With this aspect, the volume of the primary combustion zone 88 may be partially expanded via access to a portion of the outer liner expanded primary volume portion 104, rather than providing a full access to the outer liner expanded primary volume portion 104. This aspect may allow for a better control of the expanded volume of the primary combustion zone 88 through more operating conditions.

Figure 5:
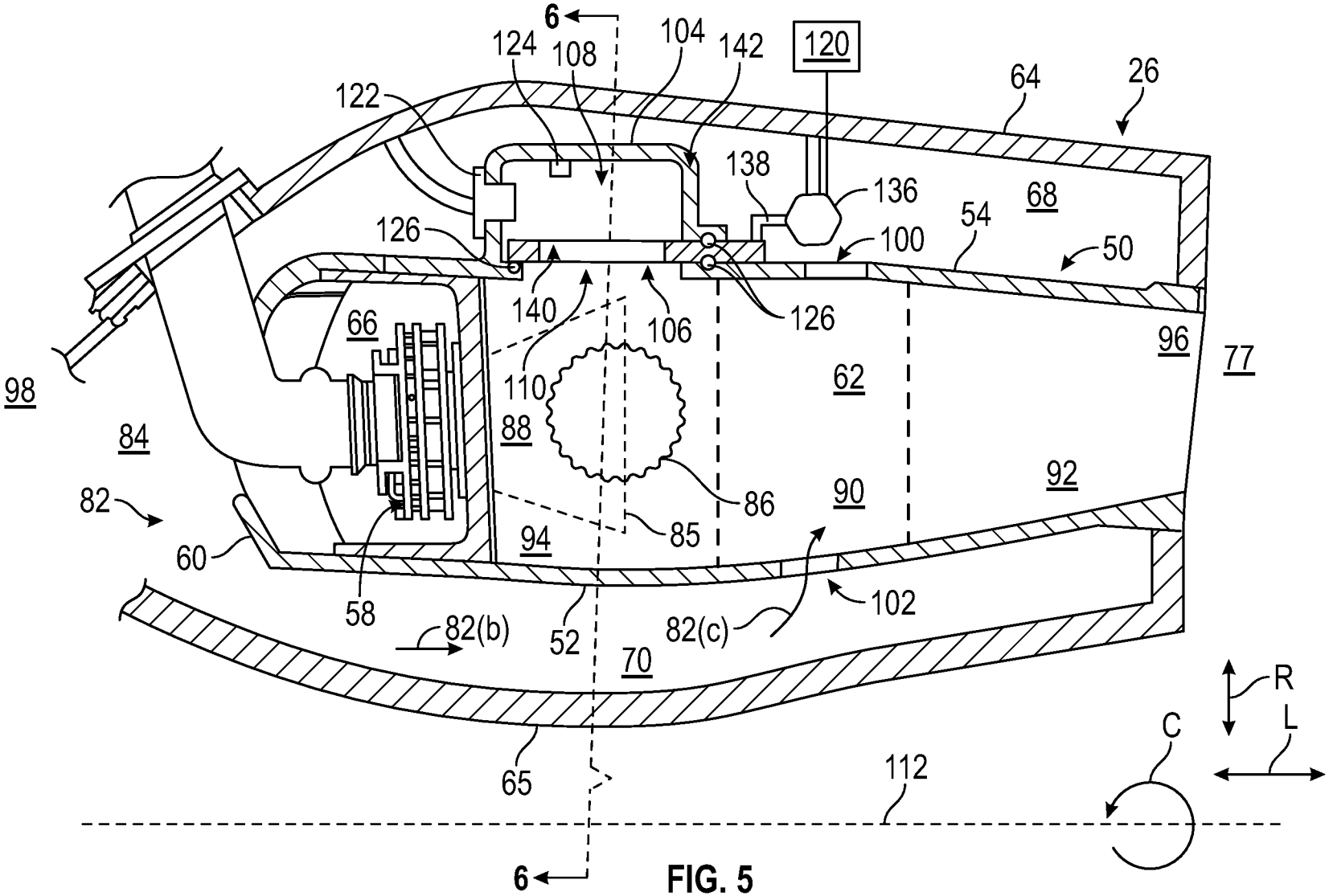
FIG. 5 is a cross-sectional side view of a combustor, according to yet another aspect of the present disclosure.

The foregoing aspects of FIGS. 2 to 4 provide for longitudinal movement of the secondary outer liner portion 106 to adjust the volume of the primary combustion zone 88. The following aspects, on the other hand, provide for rotational movement of the various combustor components to expand the volume of the primary combustion zone 88. FIG. 5 is a cross-sectional side view of an exemplary combustor 26, according to yet another aspect of the present disclosure. The FIG. 5 aspect includes the outer liner expanded primary volume portion 104 that is integral with the outer liner 54, and the secondary outer liner portion 106 that is movable. The secondary outer liner portion 106 extends circumferentially about the combustor centerline axis 112 and extends in the longitudinal direction across the inner side 110 of the outer liner expanded primary volume portion 104. The secondary outer liner portion 106 also includes a plurality of secondary outer liner portion openings 140 therethrough that are circumferentially spaced apart from one another about the secondary outer liner portion 106. The plurality of secondary outer liner portion openings 140 may be in the form of slotted openings or rectangular-shaped openings through the secondary outer liner portion 106. The secondary outer liner portion 106 is movable and is arranged to be rotationally actuated about the combustor centerline axis 112 to rotate the plurality of secondary outer liner portion openings 140 to open and to close access to the outer liner expanded primary volume portion 104. More specifically, an actuator 136 may be connected to the secondary outer liner portion 106 via an actuator connecting linkage 138 so as to provide rotational movement of the secondary outer liner portion 106 about the combustor centerline axis 112. Similar to the FIG. 2 aspect, seals 126 may be provided between the outer liner expanded primary volume portion 104 and the secondary outer liner portion 106. The FIG. 5 aspect may also include the secondary fuel nozzle 122 and the secondary ignitor 124 within the outer liner expanded primary volume portion 104 as was described above.

Figure 6A:
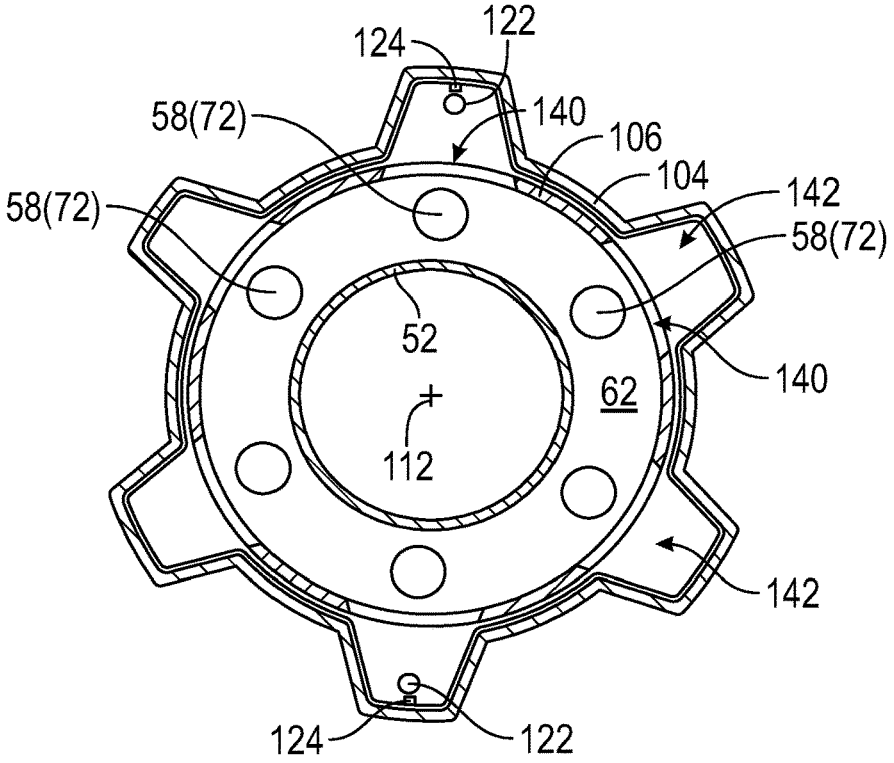
FIGS. 6A and 6B are cross-sectional views of the combustor liner taken at plane 6-6 of FIG. 5, according to an aspect of the present disclosure.
Figure 6B:
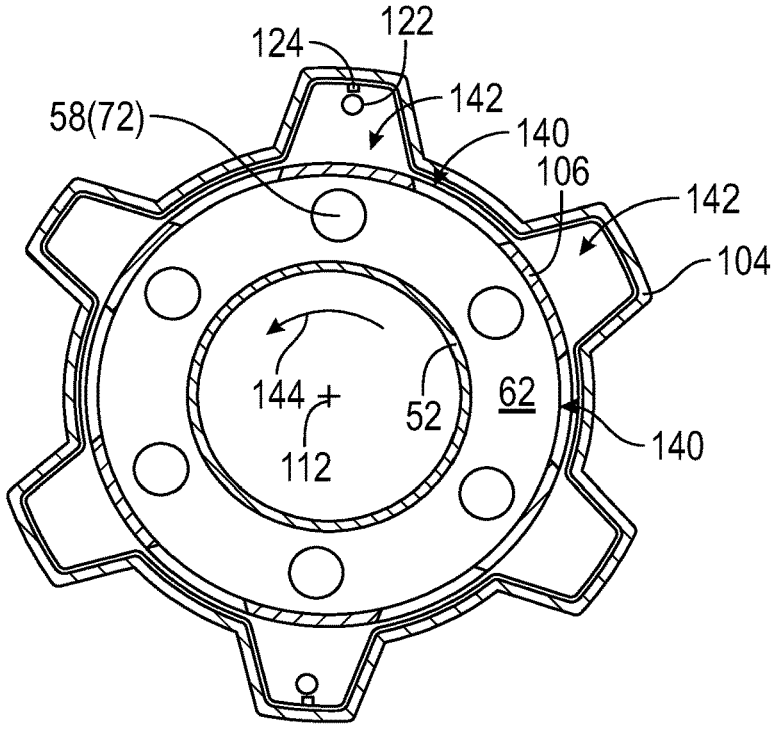

FIGS. 6A and 6B are cross-sectional views of the combustor liner 50 taken at plane 6-6 of FIG. 5. In FIG. 6, the outer liner expanded primary volume portion 104 is seen to include a plurality of expanded primary volume chambers 142 that are circumferentially spaced apart from one another about the combustor centerline axis 112. That is, rather than the outer liner expanded primary volume portion 104 defining the expanded primary combustion zone cavity 108 circumferentially about the combustor centerline axis 112 as shown in FIG. 3, the outer liner expanded primary volume portion 104 defines the expanded primary volume chambers 142 localized with respect the respective mixer assembly 58 and associated fuel nozzle 72 about the combustor 26. Thus, when the secondary outer liner portion 106 is rotated to a position as shown in FIGS. 5 and 6A with respective ones of the secondary outer liner portion openings 140 aligning with respective ones of the expanded primary volume chambers 142, access to the outer liner expanded primary volume portion 104 is opened and the volume of the primary combustion zone 88 is expanded. On the other hand, as shown in FIG. 6B, when the secondary outer liner portion 106 is rotated in a rotation direction 144 about the combustor centerline axis 112 to a position as shown in FIG. 6B, the respective ones of the secondary outer liner portion openings 140 are not aligned with respective ones of the expanded primary volume chambers 142, and access to the outer liner expanded primary volume portion 104 is closed and the volume of the primary combustion zone 88 is not expanded.

Figure 7:
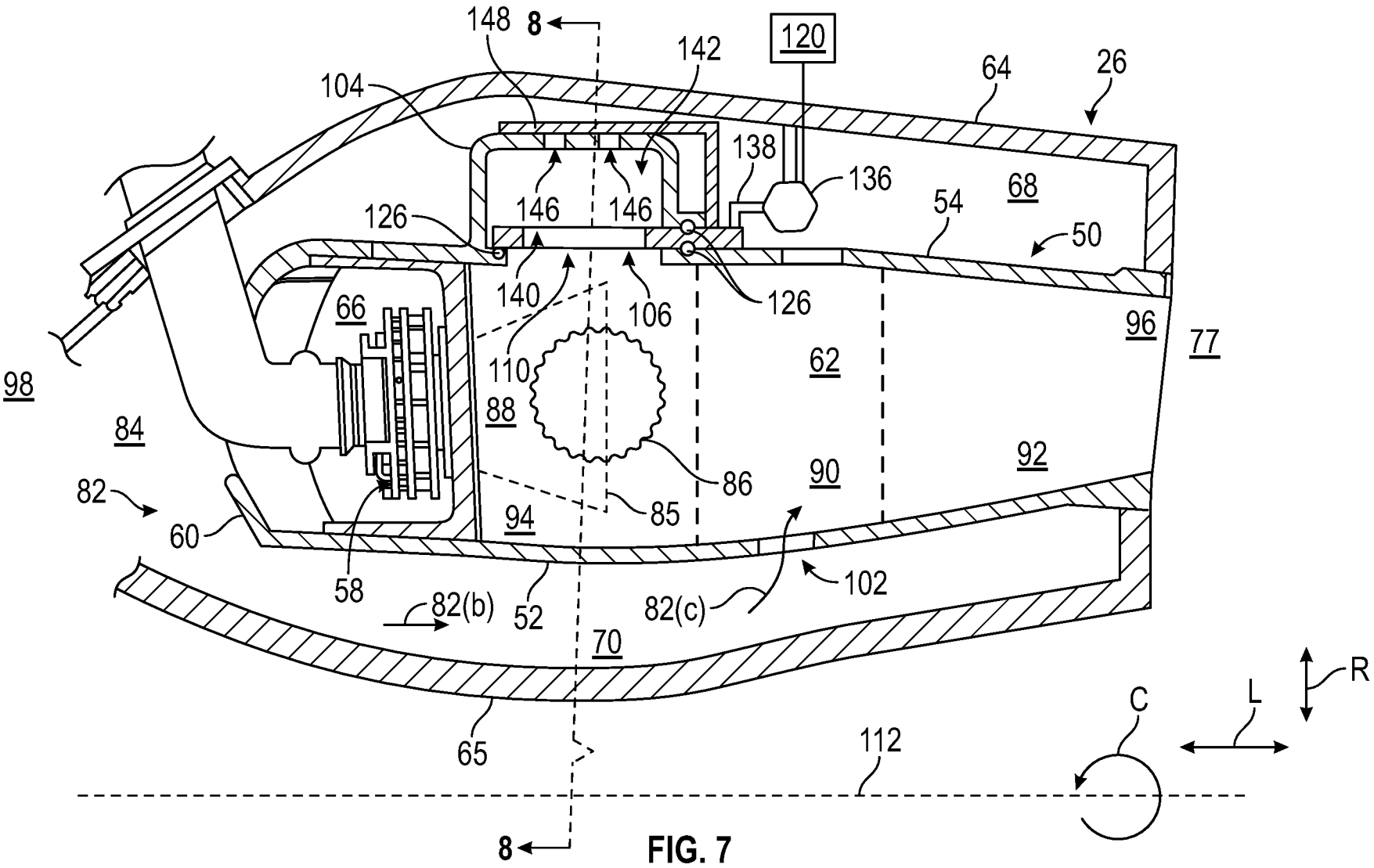
FIG. 7 is a cross-sectional side view of an exemplary combustor 26, according to still another aspect of the present disclosure.
Figure 8A:
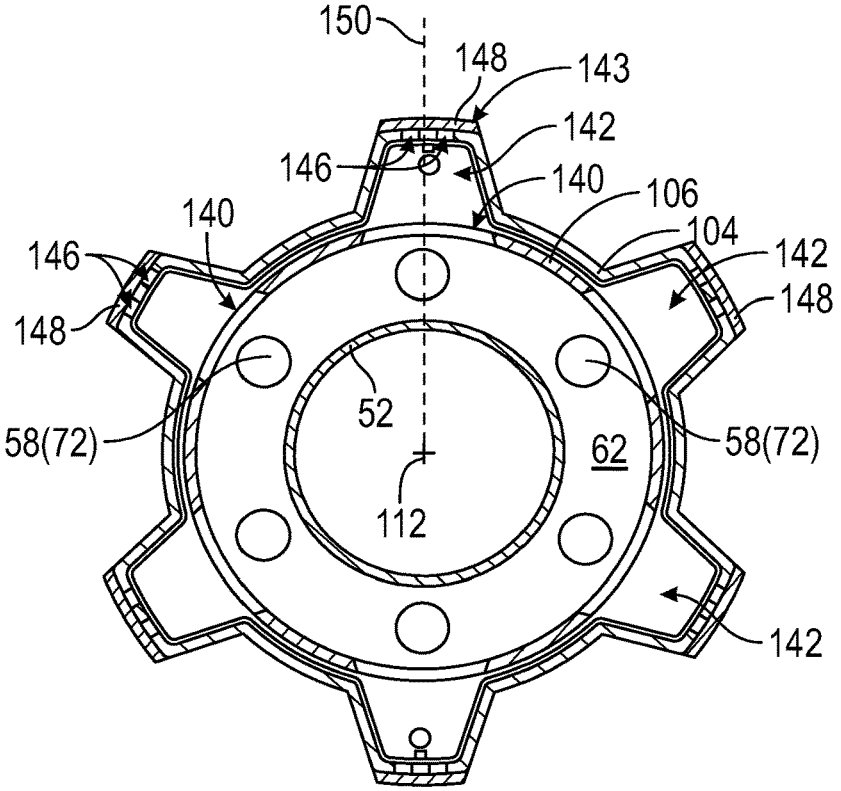
FIGS. 8A and 8B are cross-sectional views of the combustor liner taken at plane 8-8 of FIG. 7, according to an aspect of the present disclosure.
Figure 8B:
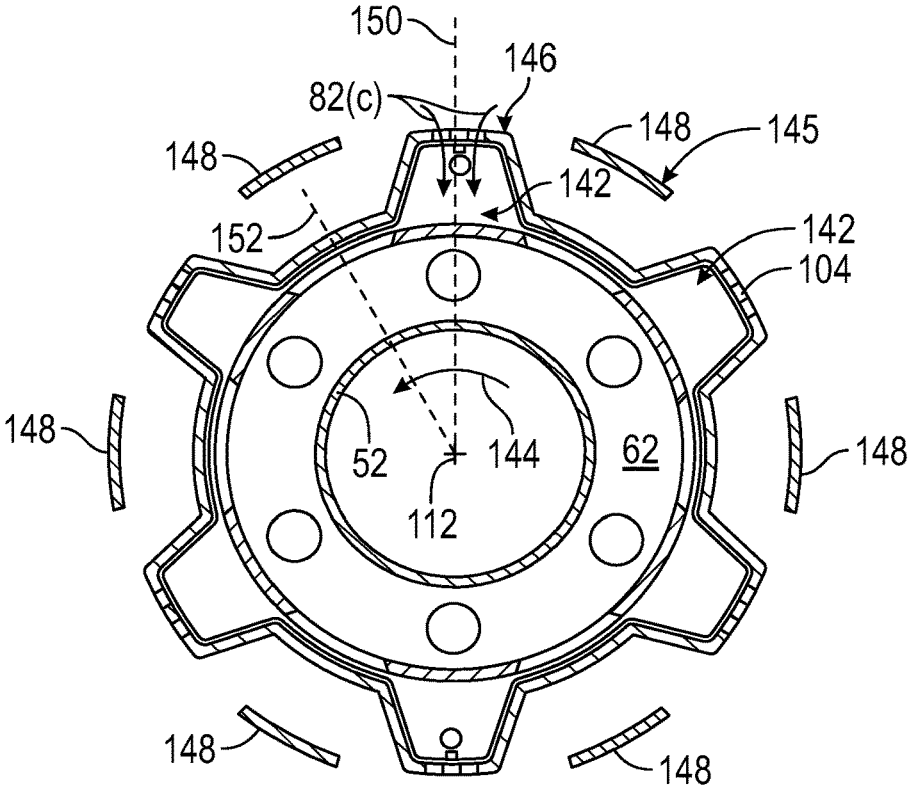

FIG. 7 is a cross-sectional side view of an exemplary combustor 26, according to still another aspect of the present disclosure. The FIG. 7 aspect is similar to the FIG. 5 aspect, with one difference being that each of the plurality of expanded primary volume chambers 142 includes at least one cooling passage 146 therethrough, and the secondary outer liner portion 106 further includes a plurality of cooling passage engagement members 148. FIGS. 8A and 8B are cross-sectional views of the combustor liner 50 taken at plane 8-8 of FIG. 7. As seen in FIG. 7 and FIG. 8A, when the secondary outer liner portion 106 is rotated to a first position 143 defined with respect to a first radial line 150 extending from the combustor centerline axis 112 to open access to the plurality of expanded primary volume chambers 142, the plurality of cooling passage engagement members 148 engage the plurality of cooling passages 146 to close the plurality of cooling passages. On the other hand, as shown in FIG. 8B, when the secondary outer liner portion 106 is rotated in the rotation direction 144 to a second position 145 defined by a second radial line 152 to close access to the plurality of expanded primary volume chambers 142, the plurality of cooling passage engagement members 148 disengage the plurality of cooling passages 146 to allow a cooling airflow 82(*c*) to flow into the plurality of expanded primary volume chambers 142 to provide impingement cooling to the secondary outer liner portion 106.

Figure 9:
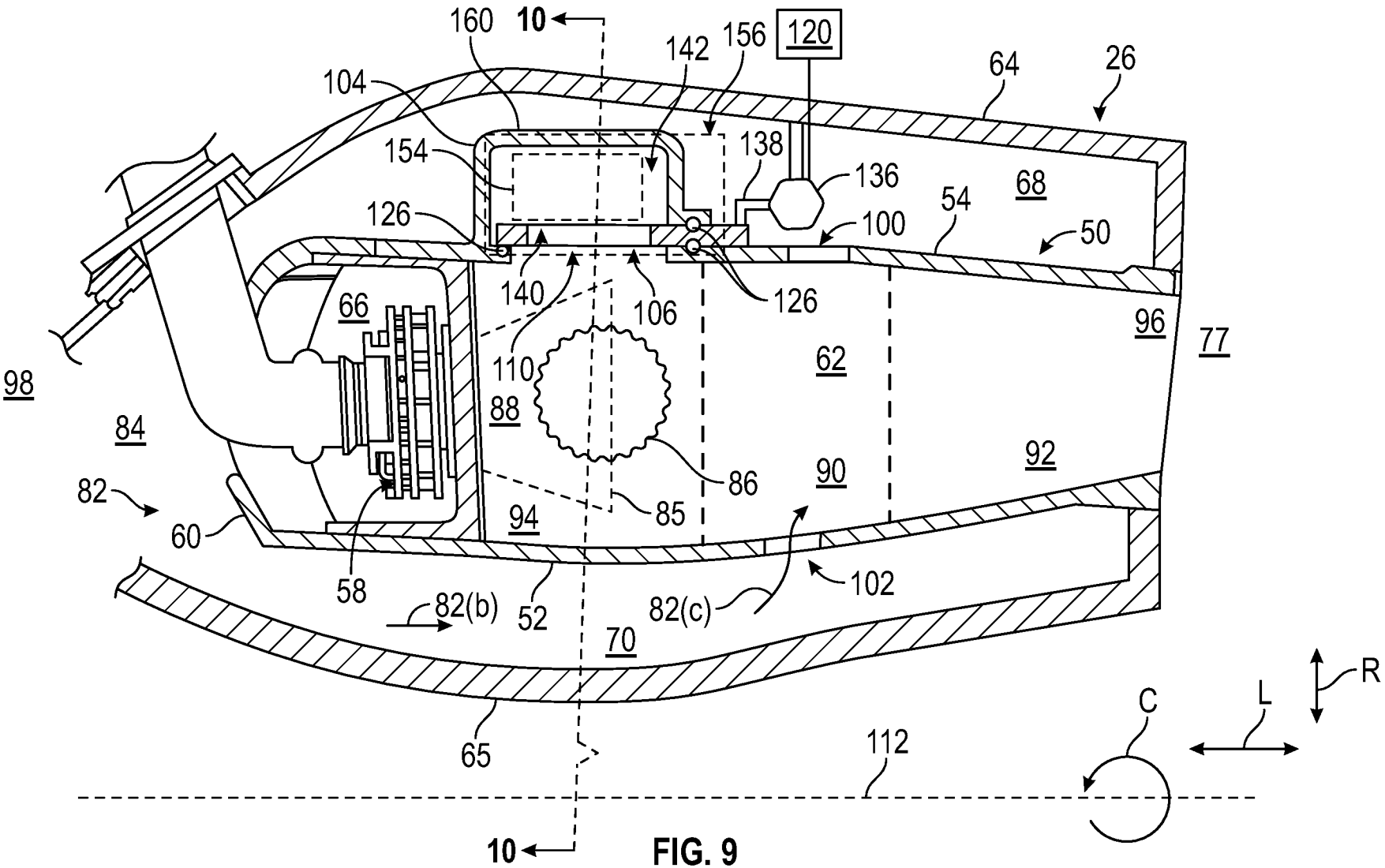
FIG. 9 is a cross-sectional side view of an exemplary combustor 26, according to still yet another aspect of the present disclosure.
Figure 10A:
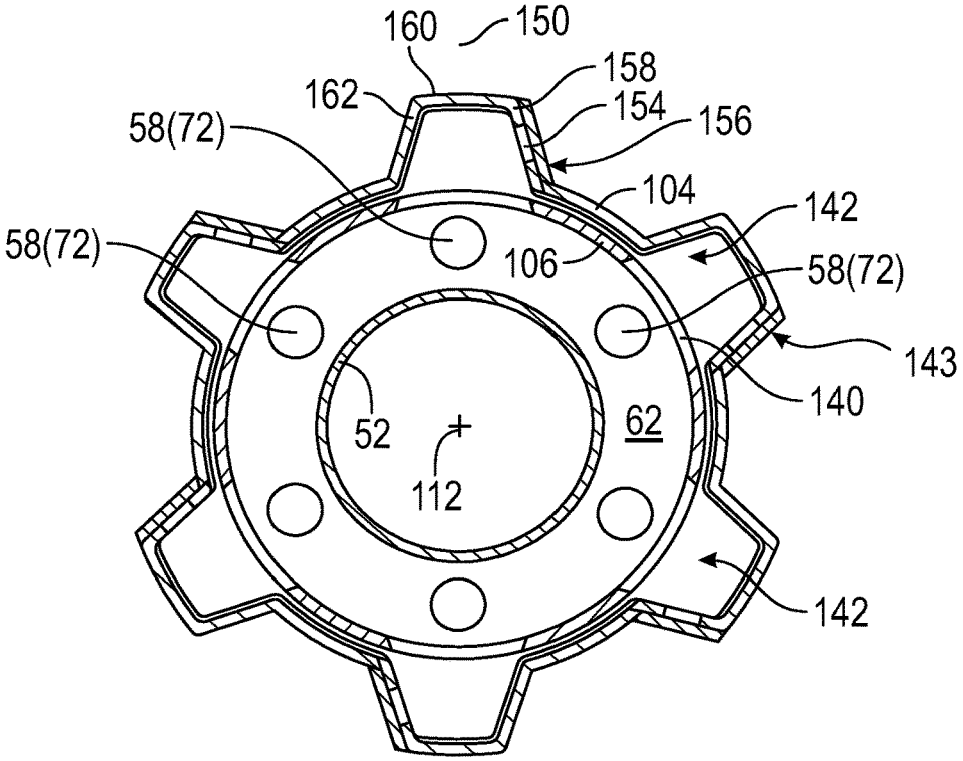
FIGS. 10A and 10B are cross-sectional views of a combustor liner taken at plane 10-10 of FIG. 9, according to an aspect of the present disclosure.
Figure 10B:
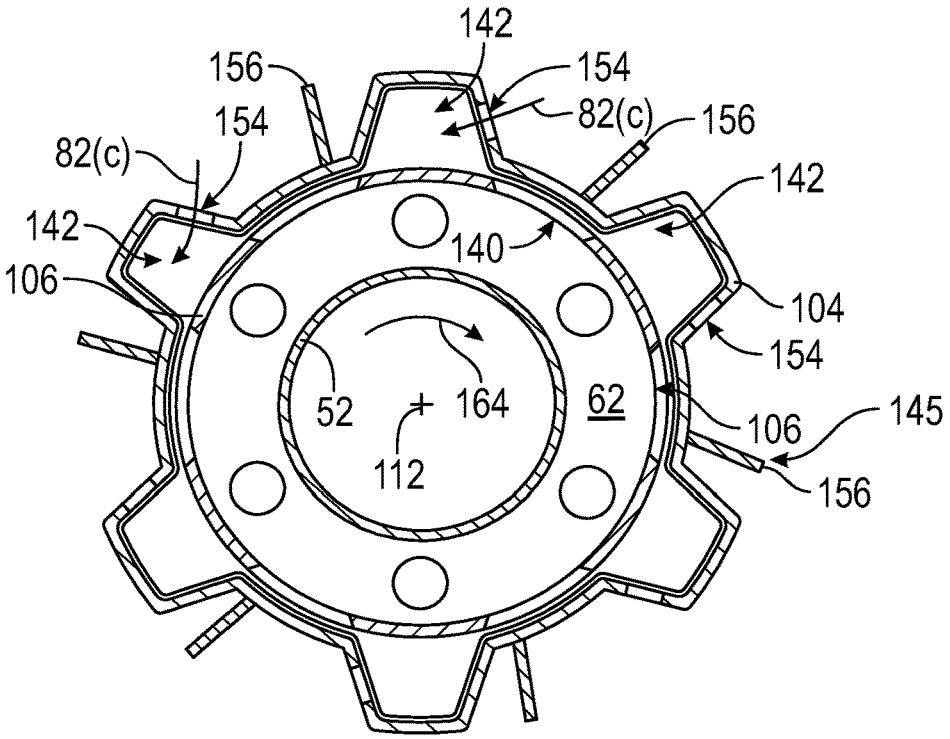

FIG. 9 is a cross-sectional side view of an exemplary combustor 26, according to still yet another aspect of the present disclosure. FIGS. 10A and 10B are cross-sectional views of the combustor liner 50 taken at plane 10-10 of FIG. 9. Referring collectively to FIGS. 9 and 10A, each of the plurality of expanded primary volume chambers 142 includes a first side 158, a second side 162 opposite the first side 158, and a radially outer side 160 connected to the first side 158 and to the second side 162. The first side 158 includes an airflow opening 154 therethrough. Similar to the FIG. 7 aspect, the secondary outer liner portion 106 includes a plurality of airflow opening engagement members 156 extending outward from the secondary outer liner portion 106. Respective ones of the plurality of airflow opening engagement members 156 are arranged to engage with respective ones of the plurality of airflow openings 154. In FIG. 9, the airflow opening 154 and the airflow opening engagement member 156 is shown with broken lines. In FIG. 10A, when the secondary outer liner portion 106 is rotated to the first position 143 with respect to the first radial line 150 to open access to the plurality of expanded primary volume chambers 142, respective ones of the airflow opening engagement members 156 engage to close the respective ones of the airflow openings 154. On the other hand, as shown in FIG. 10B, when the secondary outer liner portion 106 is rotated to the second position 145 to close access to the plurality of expanded primary volume chambers 142, the respective ones of the plurality of airflow opening engagement members 156 disengage the respective ones of the plurality of airflow openings 154 to allow the cooling airflow 82(*c*) to flow into the plurality of expanded primary volume chambers 142 to provide impingement cooling to the secondary outer liner portion 106.

Figure 11:
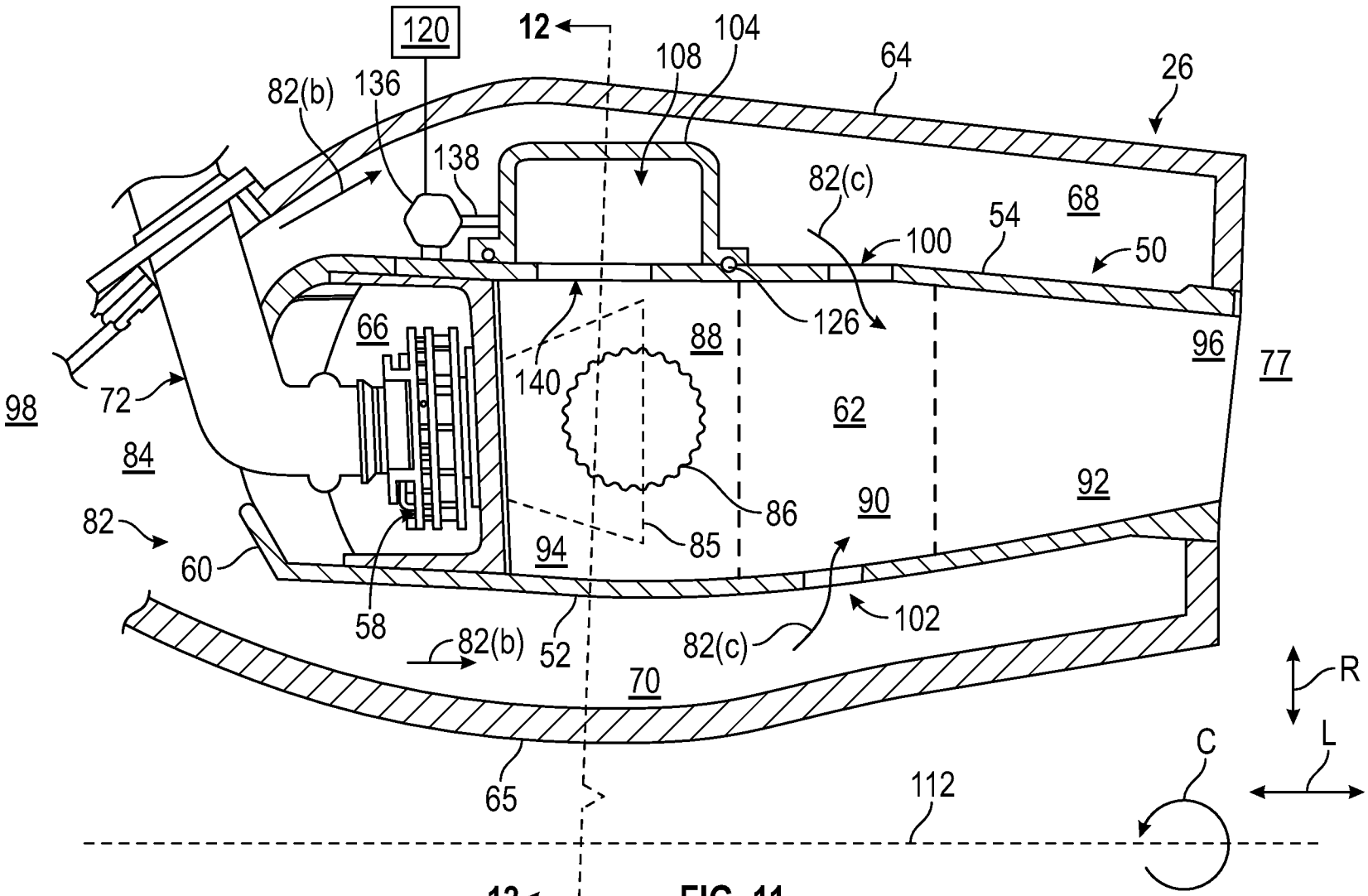
FIG. 11 is a cross-sectional side view of an exemplary combustor 26, according to still yet another aspect of the present disclosure.
Figure 12A:
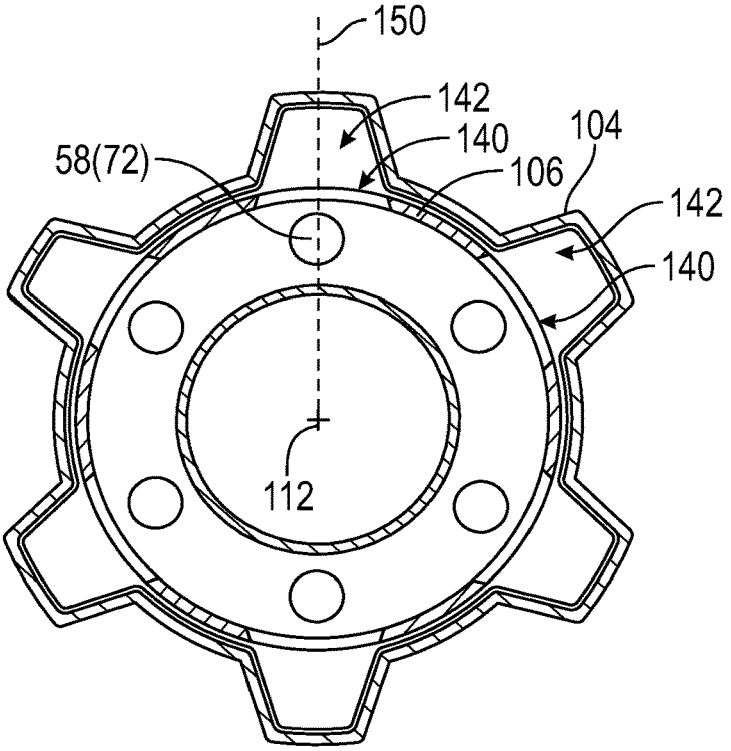
FIGS. 12A and 12B are cross-sectional views of a combustor liner taken at plane 12-12 of FIG. 11, according to an aspect of the present disclosure.
Figure 12B:
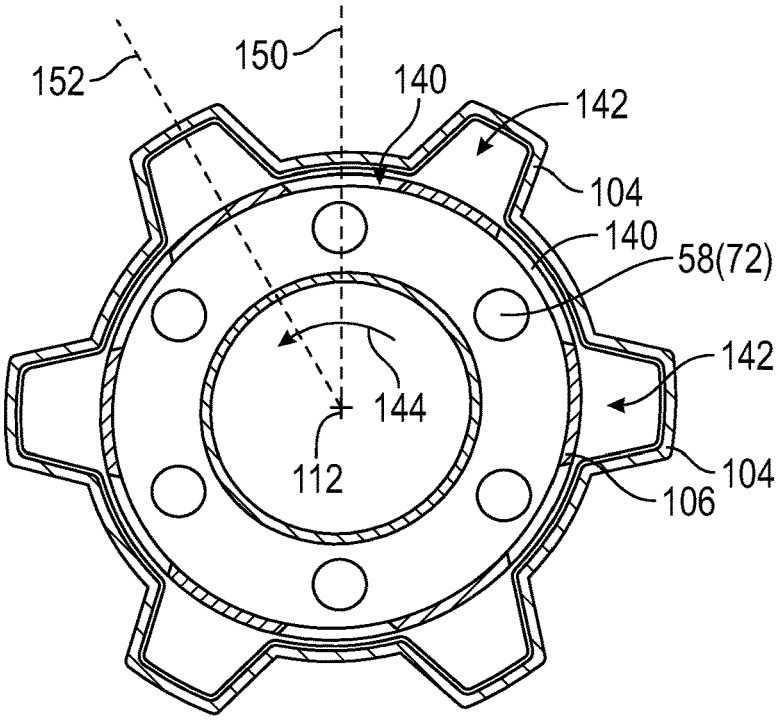

FIG. 11 is a cross-sectional side view of an exemplary combustor 26, according to still yet another aspect of the present disclosure. FIGS. 12A and 12B are cross-sectional views of the combustor liner 50 taken at plane 12-12 of FIG. 11. The FIG. 11 aspect is somewhat similar to the FIG. 5 aspect, except that the secondary outer liner portion 106 is integral with the outer liner 54, while the outer liner expanded primary volume portion 104 is movable. The secondary outer liner portion 106 includes the plurality of secondary outer liner portion openings 140 therethrough. Referring to FIG. 12A, the outer liner expanded primary volume portion 104 includes the plurality of expanded primary volume chambers 142. The outer liner expanded primary volume portion 104 is rotationally actuated by the actuator 136 to rotate about the combustor centerline axis 112. When the outer liner expanded primary volume portion 104 is rotated to the first position represented by the first radial line 150, respective ones of the plurality of secondary outer liner portion openings 140 are aligned to open with the outer liner expanded primary volume portion 104, thereby allowing access to the outer liner expanded primary volume portion 104 to expand the volume of the primary combustion zone 88. On the other hand, as shown in FIG. 12B, when the outer liner expanded primary volume portion 104 is rotated in the rotation direction 144 to the second position represented by the second radial line 152, respective ones of the plurality of secondary outer liner portion openings 140 are aligned to close with the outer liner expanded primary volume portion 104, thereby closing access to the outer liner expanded primary volume portion 104 to decrease the volume of the primary combustion zone 88 from the expanded volume.

Figure 13:
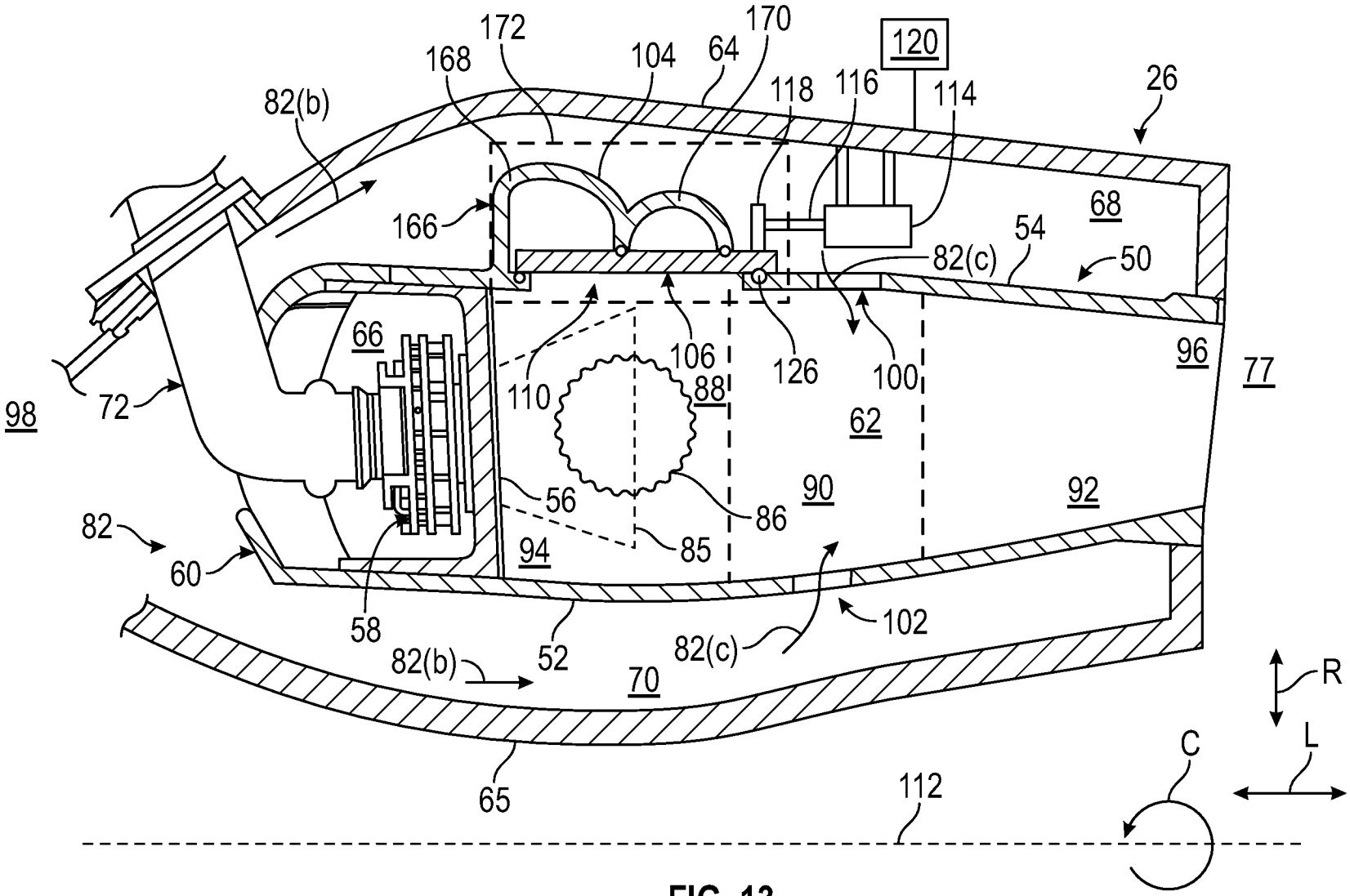
FIG. 13 is a cross-sectional side view of an exemplary combustor 26, according to yet another aspect of the present disclosure.

FIG. 13 is a cross-sectional side view of an exemplary combustor 26, according to yet another aspect of the present disclosure. The FIG. 13 aspect operates similar to the FIG. 2 aspect in that the secondary outer liner portion 106 is actuated in the longitudinal direction to open and to close access to the outer liner expanded primary volume portion 104. One difference, however, is that the outer liner expanded primary volume portion 104 defines a multi-chamber expanded primary volume portion 166 that includes an upstream expanded primary volume chamber 168 and a downstream expanded primary volume chamber 170. The secondary fuel nozzle 122 may be provided in the upstream expanded primary volume chamber 168 and a secondary fuel nozzle 123 may also be provided in the downstream expanded primary volume chamber 170. Similar to the outer liner expanded primary volume portion 104 shown in FIG. 3, both the upstream expanded primary volume chamber 168 and the downstream expanded primary volume chamber 170 extend circumferentially about the combustor centerline axis 112.

Figure 14A:
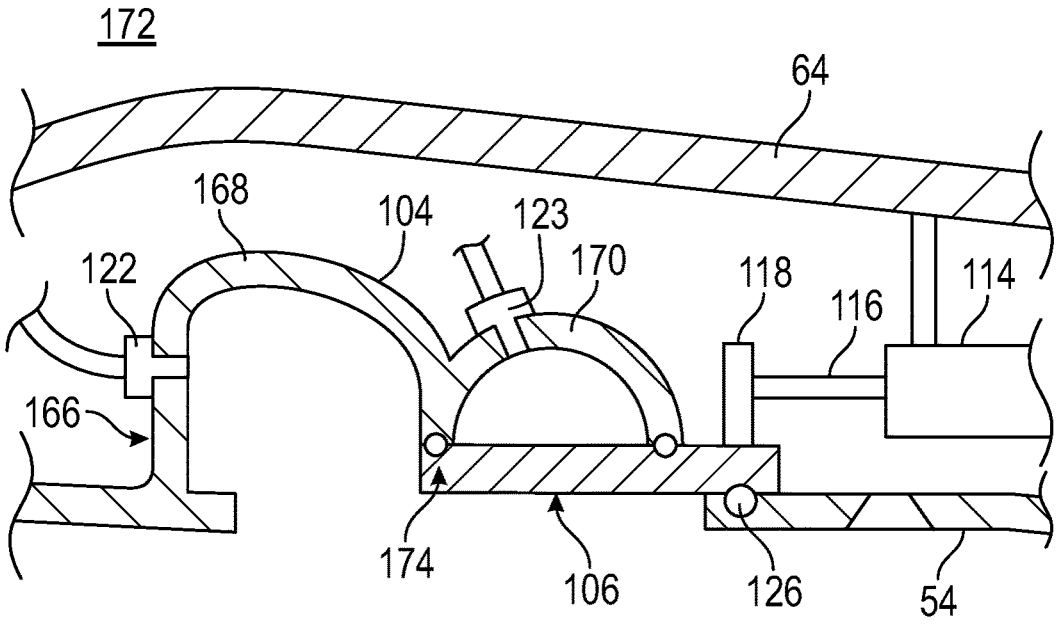
FIGS. 14A and 14B are views taken at detail view 172 of FIG. 13, according to an aspect of the present disclosure.
Figure 14B:
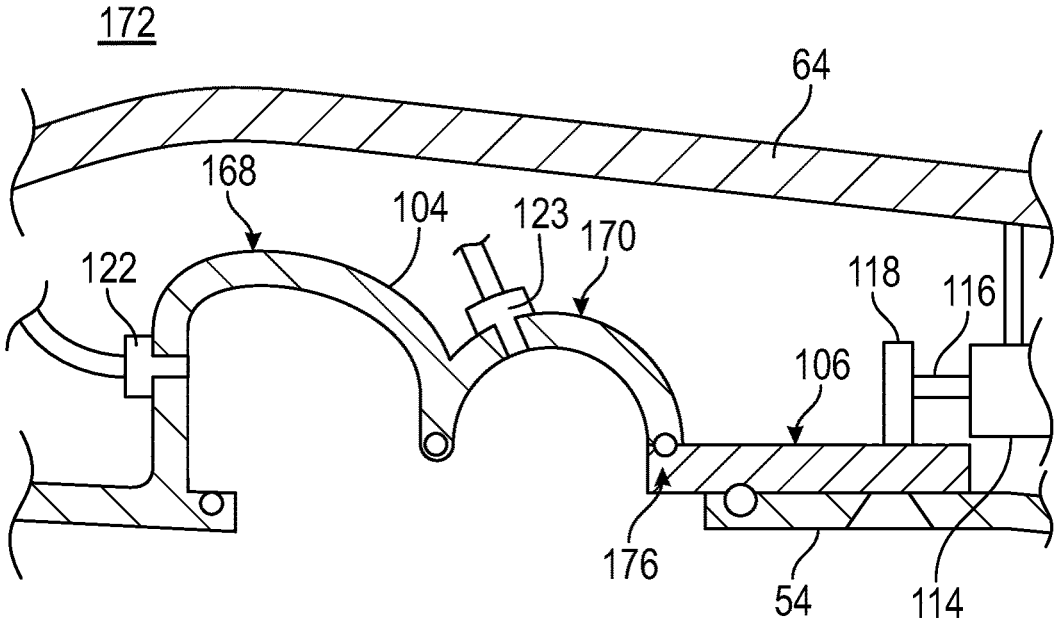

FIGS. 14A and 14B are views taken at detail view 172 of FIG. 13, detailing operation of the secondary outer liner portion 106 in the FIG. 13 aspect. In FIG. 14A, the actuator 114 is actuated to translate the secondary outer liner portion 106 in a downstream direction toward the downstream end 96 of the combustion chamber 62 from the fully closed position shown in FIG. 13 to a first position 174 so as to open access to the upstream expanded primary volume chamber 168. With this aspect, the volume of the primary combustion zone 88 can be expanded to a first expanded volume. In FIG. 14B, the actuator 114 may continue to actuate the secondary outer liner portion 106 in the downstream direction toward the downstream end 96 of the combustion chamber 62 to a second position 176 so as to open access to both the upstream expanded primary volume chamber 168 and to the downstream expanded primary volume chamber 170.

Figure 15:
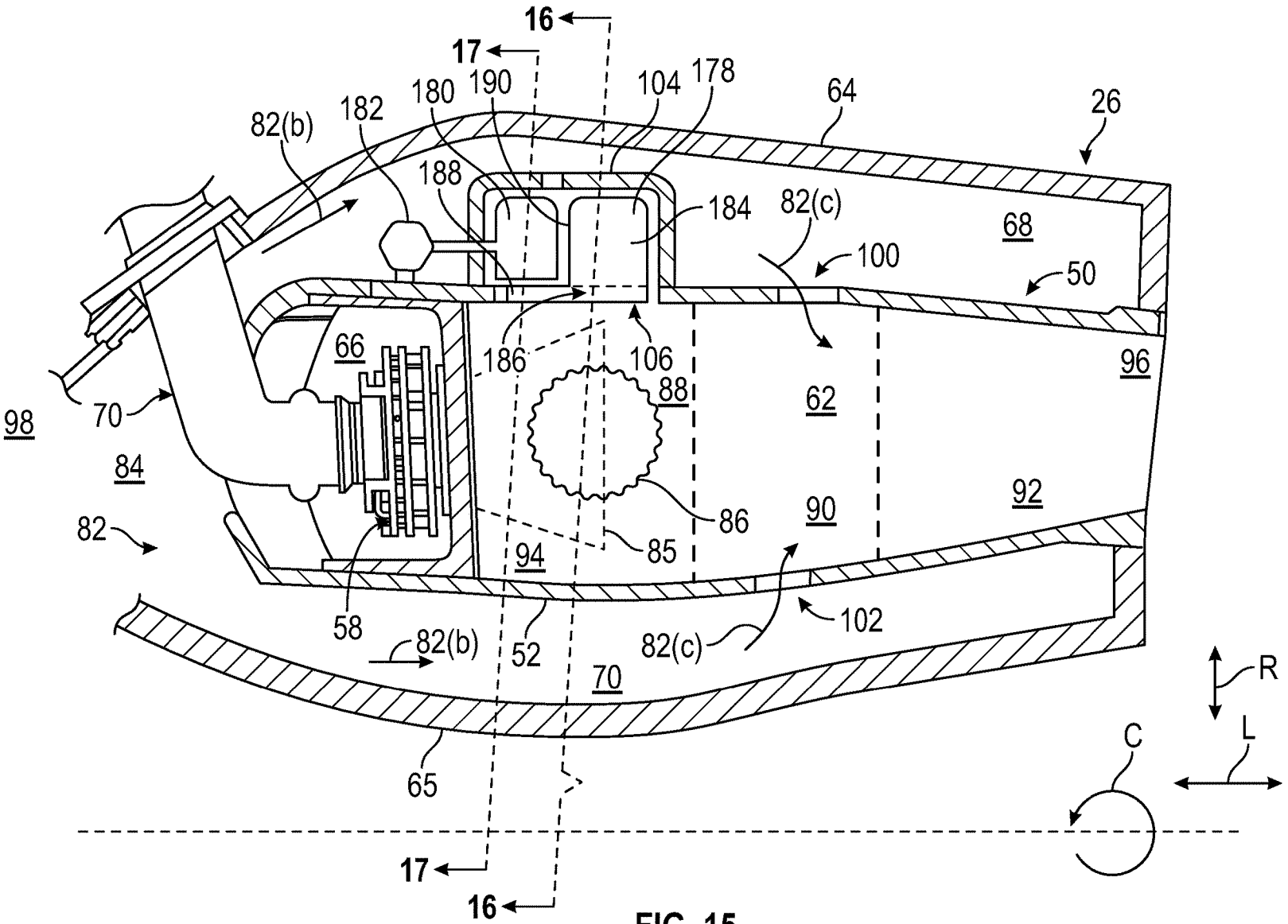
FIG. 15 is a cross-sectional side view of an exemplary combustor 26, according to still another aspect of the present disclosure.

FIG. 15 is a cross-sectional side view of an exemplary combustor 26, according to still another aspect of the present disclosure. In the FIG. 15 aspect, the outer liner expanded primary volume portion 104 is integral with the outer liner and, similar to the outer liner expanded primary volume portion 104 shown in FIG. 3, extends circumferentially about the combustor centerline axis 112. As will be described below, at least a portion of the secondary outer liner portion 106 is movable. The secondary outer liner portion 106 in FIG. 15 is arranged within the outer liner expanded primary volume portion 104 and includes a first block portion 178 and a second block portion 180 that are rotationally actuated by an actuator 182 with respect to one another so as to open and to close access to the outer liner expanded primary volume portion 104.

Figure 16:
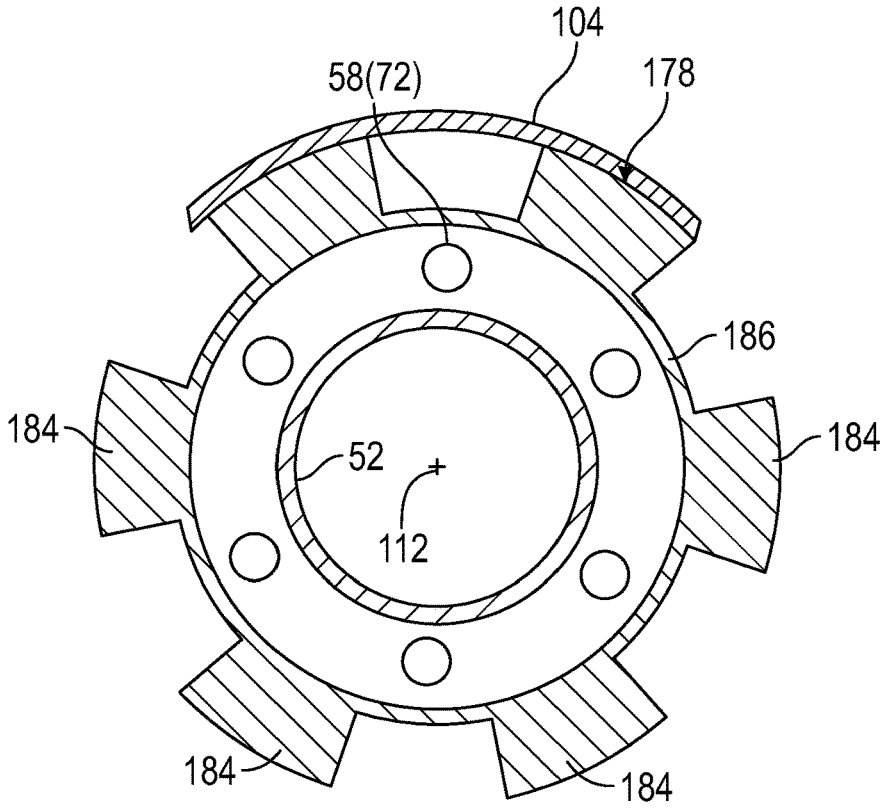
FIG. 16 is a cross-sectional view taken at plane 16-16 of FIG. 15, according to an aspect of the present disclosure.

FIG. 16 is a cross-sectional view taken at plane 16-16 of FIG. 15 depicting an example of the first block portion 178. As shown in FIG. 16, the first block portion 178 includes a plurality of first block sections 184 that are circumferentially spaced apart about the combustor centerline axis 112. Each of the first block sections 184 may be connected to, or formed integral with, a first block portion circumferential wall 186 that extends circumferentially about the combustor centerline axis 112. Referring back to FIG. 15, the first block portion circumferential wall 186 includes an upstream extension portion 188 that extends upstream in the longitudinal direction from an upstream side 190 of the plurality of first block sections 184.

Figure 17:
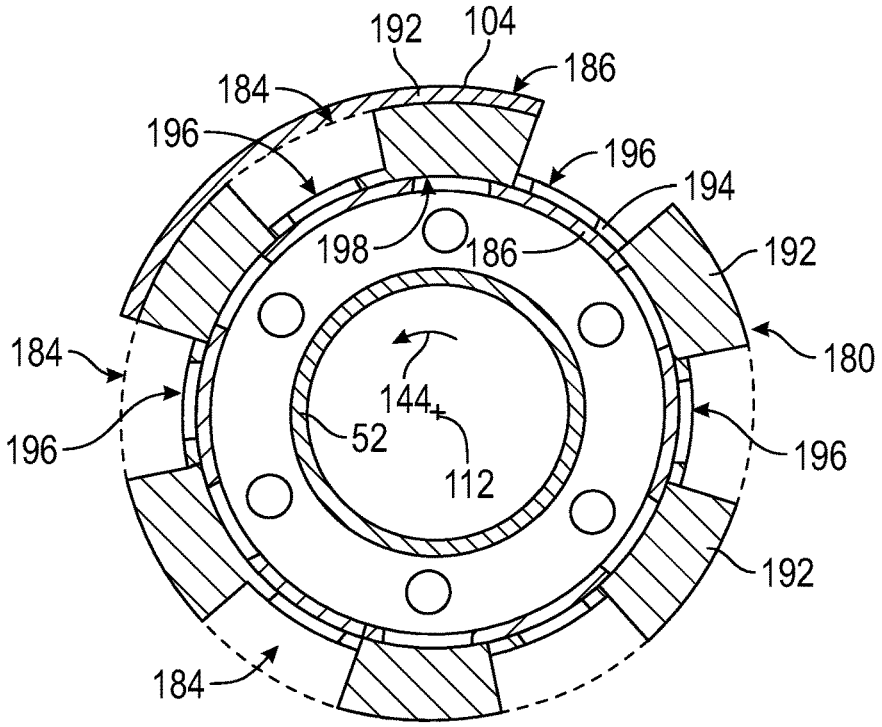
FIG. 17 is a cross-sectional view taken at plane 17-17 of FIG. 15, according to an aspect of the present disclosure.

FIG. 17 is a cross-sectional view taken at plane 17-17 of FIG. 15 depicting an example of the second block portion 180. As shown in FIG. 17, the second block portion 180 includes a plurality of second block sections 192 that are circumferentially spaced apart about the combustor centerline axis 112. The second block portion 180 may include a second block portion circumferential wall 194 that extends circumferentially about the combustor centerline axis 112, where each of the plurality of second block sections 192 may be connected to, or formed integral with the second block portion circumferential wall 194. The second block portion circumferential wall 194 also includes a plurality of second block portion airflow openings 196 that are circumferentially spaced apart between each of the plurality of second block sections 192. The plurality of second block portion airflow openings 196 may be in the form of slotted openings or rectangular-shaped openings through the second block portion circumferential wall 194. The cross-sectional view of FIG. 17 also includes a cross section through the upstream extension portion 188 of the first block portion circumferential wall 186, and, as shown in FIG. 17, the upstream extension portion 188 includes a plurality of first block portion airflow openings 198 therethrough. The plurality of first block portion airflow openings 198 may be in the form of slotted openings or rectangular-shaped openings through the upstream extension portion 188. For reference, the plurality of first block sections 184 are shown with dashed lines in FIG. 17, and, as can be seen in FIG. 17, each of the plurality of first block portion airflow openings 198 are circumferentially spaced apart between the plurality of first block sections 184.

In operation, the first block portion 178 may be fixedly connected within the combustor 26 so that the first block portion 178 does not rotate about the combustor centerline axis 112. On the other hand, the second block portion 180 may be connected with the actuator 182, which provides rotational movement of the second block portion 180 about the combustor centerline axis 112. In a state when the access to the outer liner expanded primary volume portion 104 is closed, the first block portion 178 may be arranged as shown in FIG. 16 and the second block portion 180 may be arranged as shown in FIG. 17. Thus, as shown in FIG. 17, the second block portion 180 is positioned to cover the first block portion airflow openings 198. To open access to the outer liner expanded primary volume portion 104, the second block portion 180 may be actuated by the actuator 182 to rotate in the rotation direction 144 (i.e., counterclockwise in FIG. 17) so that the first block portion airflow openings 198 and the second block portion airflow openings 196 are aligned. That is, in FIG. 17, the plurality of second block sections 192 are rotated so as to overlap with the first block sections 184 shown in dashed lines. Of course, an arrangement can be implemented in which the first block portion 178 is movable and the second block portion 180 is fixedly connected in the combustor 26, or an arrangement where both the first block portion 178 and the second block portion 180 may both be movable so as to open and to close access to the outer liner expanded primary volume portion 104.

Figure 18:
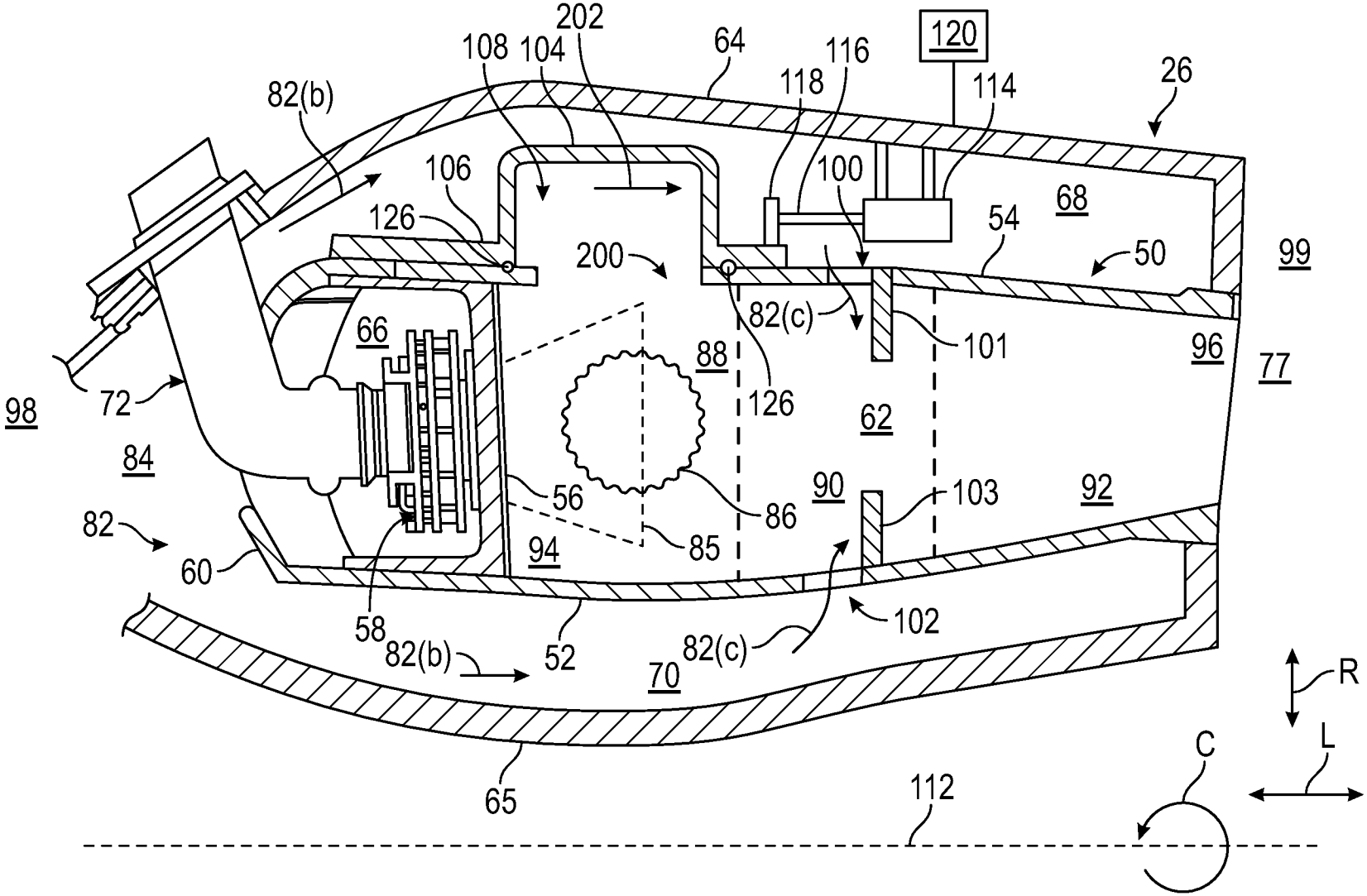
FIG. 18 is a cross-sectional side view of an exemplary combustor 26, according to still yet another aspect of the present disclosure.

FIG. 18 is a cross-sectional side view of an exemplary combustor 26, according to still yet another aspect of the present disclosure. The FIG. 18 aspect is somewhat similar to the FIG. 2 aspect, except that the outer liner expanded primary volume portion 104 and the secondary outer liner portion 106 are formed integral with each other and are both movable together. Similar to the FIG. 2 aspect, in which the secondary outer liner portion 106 is translated longitudinally by the actuator 114, in the FIG. 18 aspect, the integral outer liner expanded primary volume portion 104 and the secondary outer liner portion 106 are translated longitudinally as a single unit. In the position shown in FIG. 18, the integral outer liner expanded primary volume portion 104 and the secondary outer liner portion 106 are positioned by the actuator 114 such that access through an outer liner opening 200 in the outer liner 54 to the outer liner expanded primary volume portion 104 is opened to expand the volume of the primary combustion zone 88. On the other hand, the integral outer liner expanded primary volume portion 104 and the secondary outer liner portion 106 can be translated longitudinally in a downstream direction 202 so that the secondary outer liner portion 106 of the integral outer liner expanded primary volume portion 104 and the secondary outer liner portion 106 cover the outer liner opening 200 to close access to the outer liner expanded primary volume portion 104.

Figure 19A:
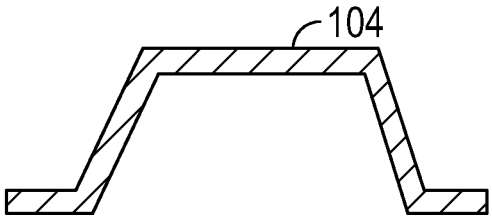
FIGS. 19A to 19D depict cross-sectional views of exemplary outer liner expanded primary volume portions, according to aspects of the present disclosure.
Figure 19B:
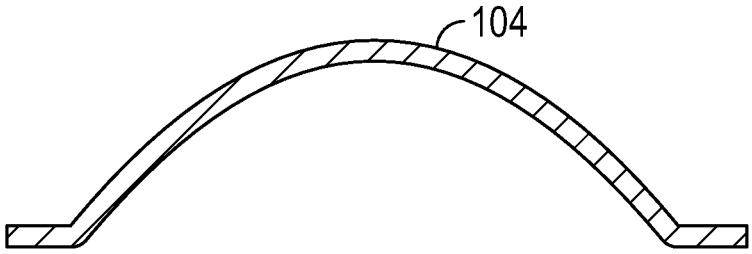
Figure 19C:
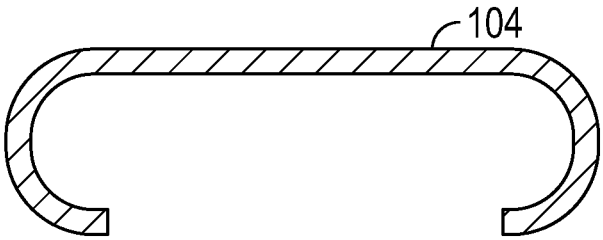
Figure 19D:
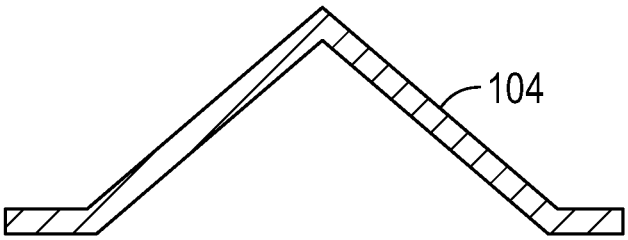

In each of the aspects depicted in FIG. 2 to FIG. 12A and FIG. 15 to FIG. 18, the side cross-sectional view of the outer liner expanded primary volume portion 104 is depicted as generally being U-shaped. However, the outer liner expanded primary volume portion 104 is not limited to being U-shaped, and other shapes may be implemented instead. For example, as shown in FIGS. 19A to 19D, the outer liner expanded primary volume portion 104 may be implemented with a trapezoidal shape (FIG. 19A), a semi-circular shape or an arc shape (FIG. 19B), an oval shape (FIG. 19C), or a triangular shape (FIG. 19D). Of course, these are but a few examples and other shapes may be implemented instead.

Figure 20:
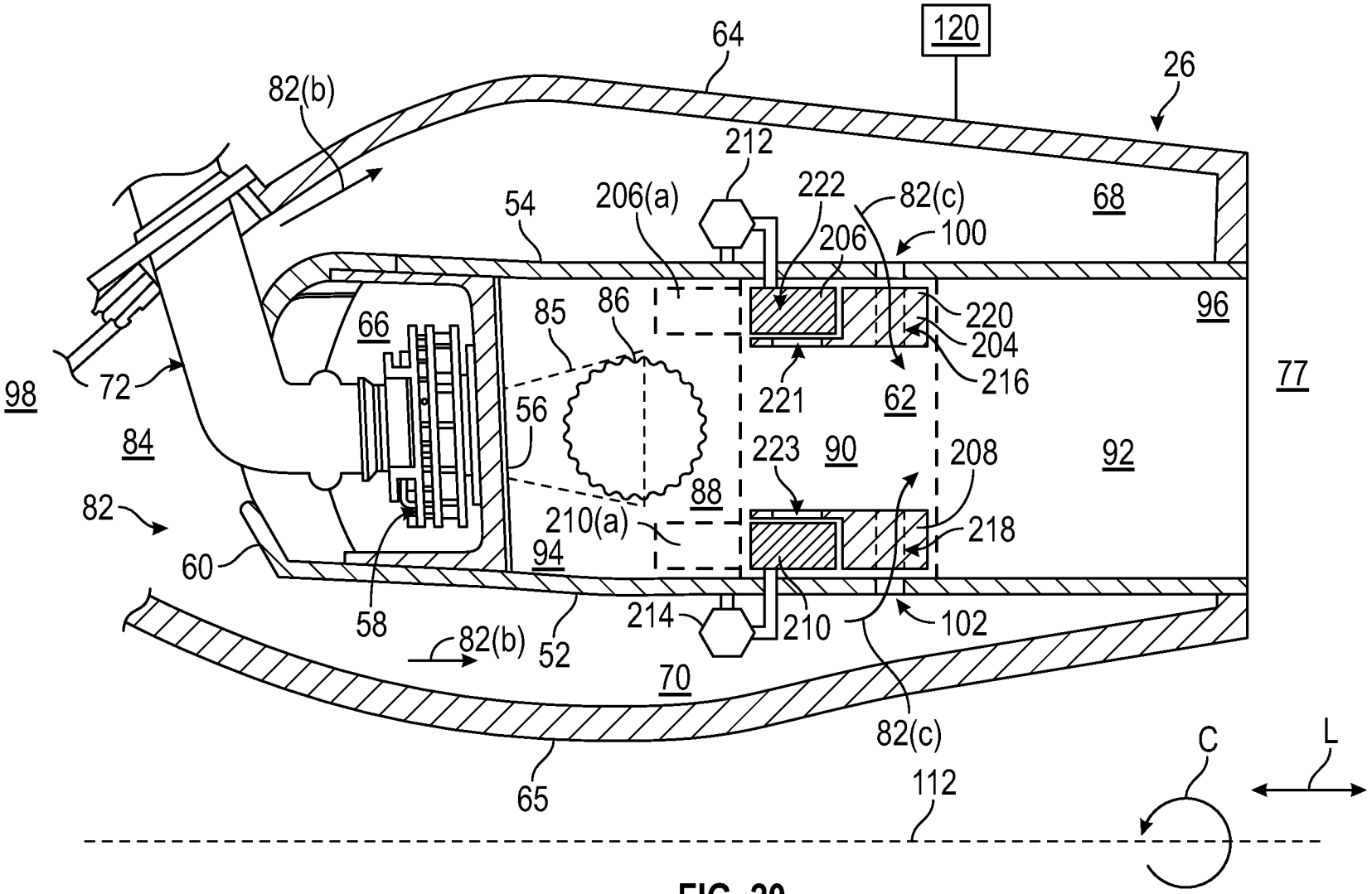
FIG. 20 is a cross-sectional side view of an exemplary combustor, according to still another aspect of the present disclosure.

FIG. 20 is a cross-sectional side view of another exemplary combustor 26, according to still yet another aspect of the present disclosure. In the FIG. 20 aspect, a plurality of block portions are provided for both the outer liner 54 and the inner liner 52 at the dilution zone 90 to form a converging-diverging dilution zone 90. At the outer liner 54, a first outer liner block portion 204 may be fixed to the outer liner 54, while a second outer liner block portion 206 may be either rotational movable about the combustor centerline axis 112 or longitudinally movable with respect to the combustor centerline axis 112 via an outer liner actuator 212. Similarly, at the inner liner 52, a first inner liner block portion 208 having a plurality of first inner liner block portion airflow openings 223 may be fixed to the inner liner 52, while a second inner liner block portion 210 may be either rotational movable about the combustor centerline axis 112 or longitudinally movable with respect to the combustor centerline axis 112 via an inner liner actuator 214. The first outer liner block portion 204 is similar to the first block portion 178 of FIGS. 15 to 17, and the second outer liner block portion 206 is similar to the second block portion 180 of FIGS. 15 to 17. The second outer liner block portion 206 is rotationally movable about the combustor centerline axis 112 via the outer liner actuator 212 in the same manner as the second block portion 180 (FIG. 17) so as to expand and contract the size of the dilution zone 90. The second inner liner block portion 210 is likewise rotationally actuated by the inner liner actuator 214 to open and close the plurality of first inner liner block portion airflow openings 223 so as to expand and contract the size of the dilution zone 90. In addition, the outer liner actuator 212 may actuate the second outer liner block portion 206 longitudinally (shown as second outer liner block portion 206(*a*)) so as to expand and contract the length of the converging-diverging portion, and to also reduce the size of the primary combustion zone 88. Similarly, the inner liner actuator 214 may actuate the second inner liner block portion 210 longitudinally (shown as second inner liner block portion 210(*a*)) to expand and contract the length of the converging-diverging portion, and to also reduce the size of the primary combustion zone 88. The first outer liner block portion 204 may also include a plurality of block dilution openings 216 therethrough to allow the dilution air 82(*c*) to flow into the combustion chamber 62. Similarly, the first inner liner block portion 208 may include a plurality of block dilution openings 218 therethrough to allow the dilution air 82(*c*) to flow therethrough into the combustion chamber 62.

Similar to the plurality of first block sections 184 shown in the FIG. 16 aspect, the first outer liner block portion 204 includes a plurality of first outer liner block sections 220 that are circumferentially spaced apart about the combustor centerline axis 112. In addition, the first outer liner block portion 204 may include a plurality of first outer liner block portion airflow openings 221 that are similar to the first block portion airflow openings 198 of FIG. 17. The second outer liner block portion 206 may also include a plurality of second outer liner block sections 222 that are similar to the plurality of second block sections 192 of FIG. 17 and are circumferentially spaced apart about the combustor centerline axis 112. Thus, the first outer liner block portion 204 and the second outer liner block portion 206 are operationally similar to the aspect shown in FIGS. 15 to 17. The first inner liner block portion 208 is similar to the first outer liner block portion 204, and the second inner liner block portion 210 is similar to the second outer liner block portion 206, and together, the first inner liner block portion 208 and the second inner liner block portion 210 are also operationally similar to that of FIGS. 15 to 17.

Figure 21:
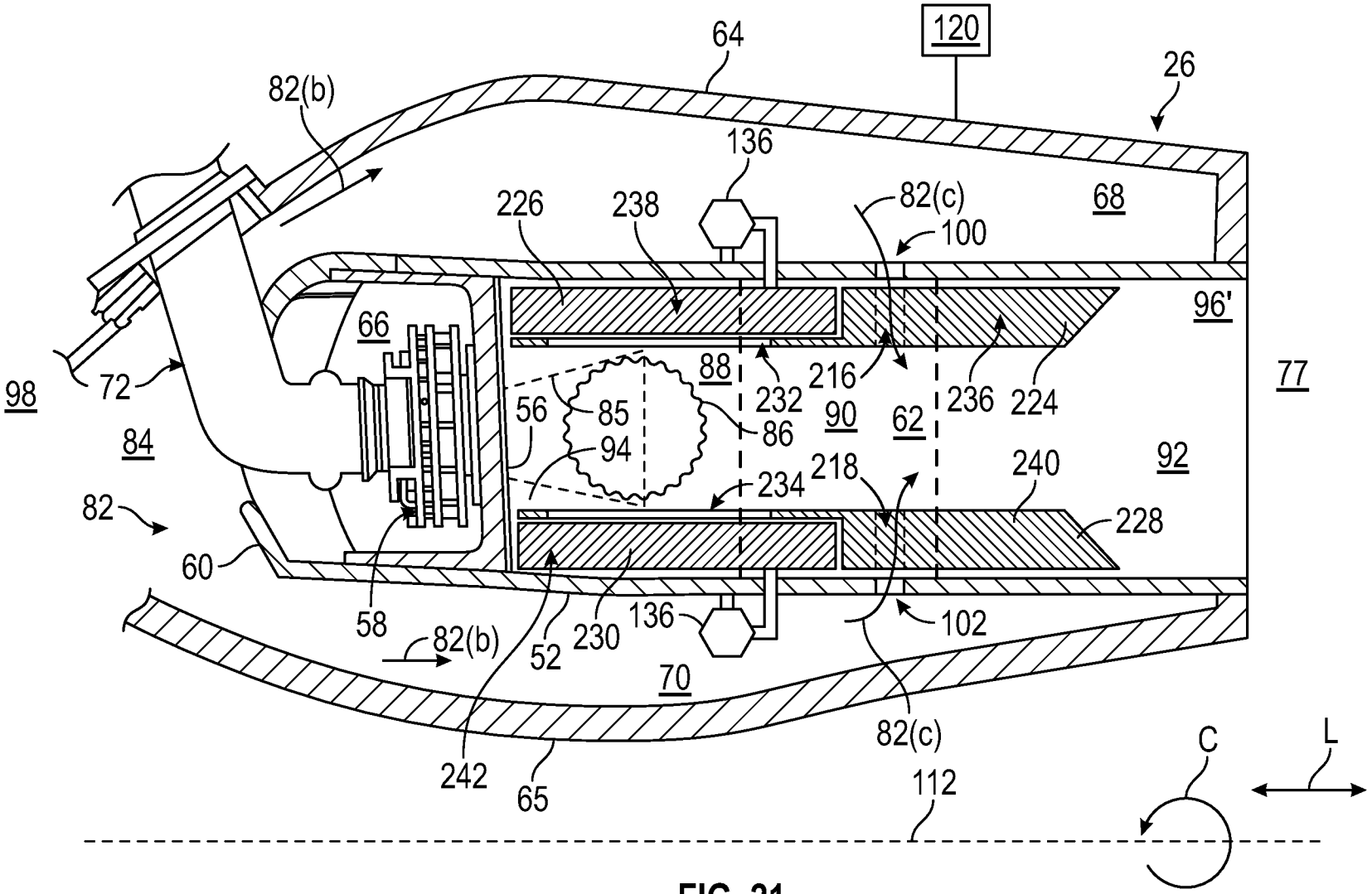
FIG. 21 is a cross-sectional side view of an exemplary combustor, according to still another aspect of the present disclosure.

FIG. 21 is a cross-sectional side view of another exemplary combustor 26, according to yet another aspect of the present disclosure. The FIG. 21 aspect is similar to the FIG. 20 aspect, with a difference being a length of the block portions within the combustor 26. In FIG. 21, a first outer liner block portion 224 extends from the dome assembly 56 at the upstream end 94 of the combustion chamber 62 into the secondary combustion zone 92. A second outer liner block portion 226 extends from the dome assembly 56 at the upstream end 94 of the combustion chamber 62 into the dilution zone 90. The first outer liner block portion 224 includes a plurality of first block sections 236 similar to the first block sections 184 (FIG. 16) and a plurality of first outer liner block portion airflow openings 232 similar to the first block portion airflow openings 198 (FIG. 17). The second outer liner block portion 226 includes a plurality of second outer liner block sections 238 similar to the second block sections 192 (FIG. 17) and the second outer liner block portion 226 is rotationally actuated about the combustor centerline axis 112 by the actuator 136 in a similar manner as that shown in FIG. 17 for the second block portion 180. The first inner liner block portion 228 similarly includes a plurality of first block sections 240 similar to the first block sections 184 (FIG. 16) and a plurality of first inner liner block portion airflow openings 234 similar to the first block portion airflow openings 198 (FIG. 17). The second inner liner block portion 230 likewise includes a plurality of second inner liner block sections 242 similar to the second block sections 192 (FIG. 17) and the second inner liner block portion 230 is rotationally actuated about the combustor centerline axis 112 by the actuator 136 in a similar manner as that shown in FIG. 17 for the second block portion 180.

Figure 22:
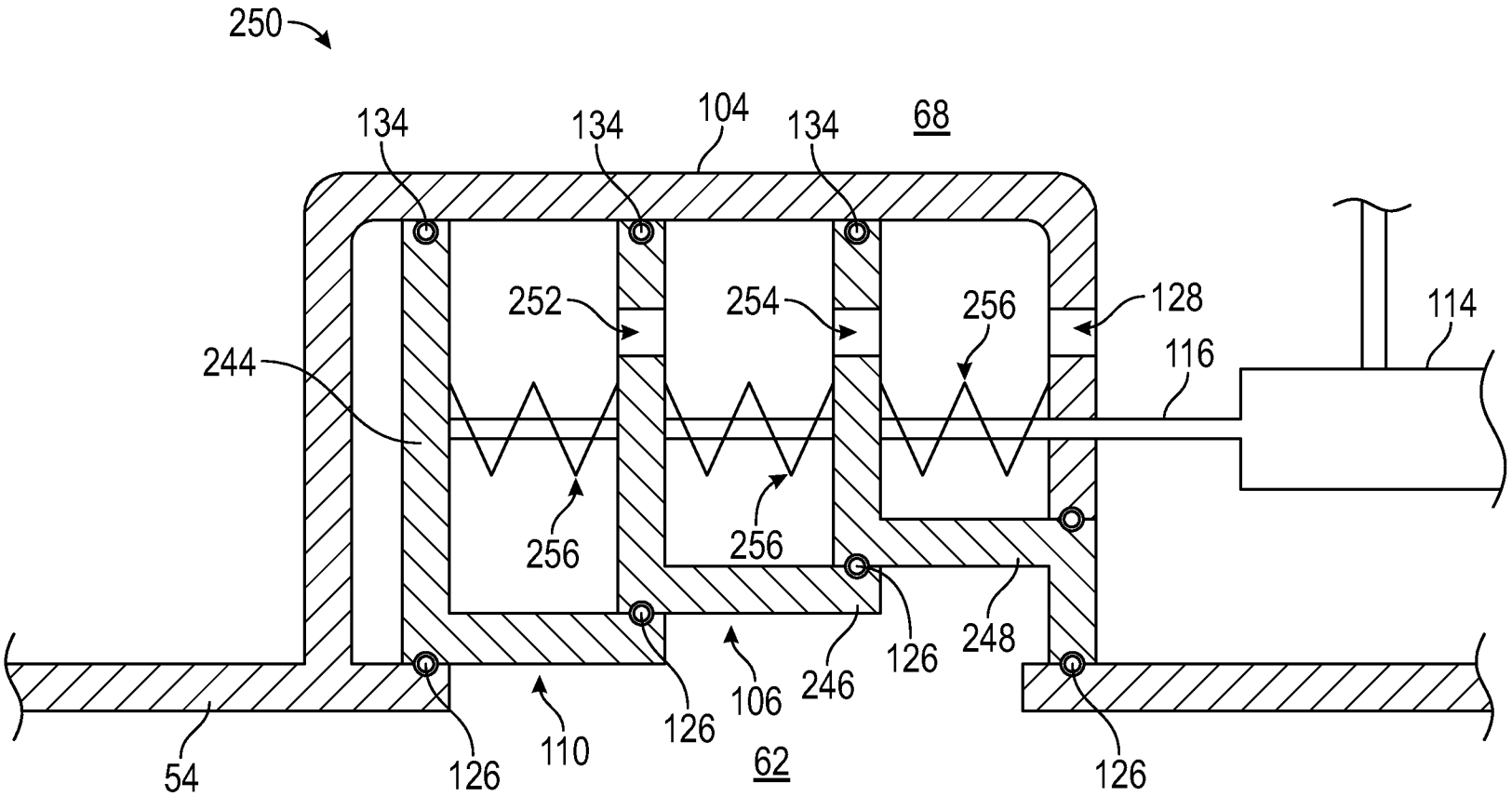
FIG. 22 is an enlarged view taken at detail 250 of FIG. 4 of an alternate arrangement of a secondary outer liner portion, according to another aspect of the present disclosure.

FIG. 22 is an enlarged view taken at detail view 250 of FIG. 4 of an alternate arrangement of the secondary outer liner portion 106, according to another aspect of the present disclosure. In FIG. 22, rather than a single piece secondary liner portion 106 having the upstream wall 130, the secondary outer liner portion 106 in FIG. 22 is shown to include multiple portions similar to the secondary outer liner portion 106 of FIG. 4 that define the secondary outer liner portion 106 of FIG. 22, including a first secondary outer liner portion 244, a second secondary outer liner portion 246, and a third secondary outer liner portion 248. The second secondary outer liner portion 246 includes an airflow opening 252 and the third secondary outer liner portion 248 includes an airflow opening 254, thereby allowing a flow of cooling air from the cooling airflow opening 128 to pass therethrough. The first secondary outer liner portion 244 may be connected to the actuator arm 116, while the actuator arm 116 may pass through an opening (not shown) in each of the second secondary outer liner portion 246 and the third secondary outer liner portion 248. A spring 256 may be provided about the actuator arm 116 between the first secondary outer liner portion 244 and the second secondary outer liner portion 246. A spring 256 may also be provided about the actuator arm 116 between the second secondary outer liner portion 246 and the third secondary outer liner portion 248, and also about the actuator arm 116 between the third secondary liner portion 248 and the outer liner expanded primary volume portion 104. With the foregoing arrangement, the actuator 114 can retract each of the first secondary outer liner portion 244, the second secondary outer liner portion 246, and the third secondary outer liner portion 248 successively so as to allow incremental access to the outer liner expanded primary volume portion 104. Each of the springs 256 provide a force to extend the actuator arm 116 when a pressure is relieved from the actuator 114 so as to incrementally close access to the outer liner expanded primary volume portion 104. In addition, each of the first secondary outer liner portion 244, the second secondary outer liner portion 246, and the third secondary outer liner portion 248 may include or function as acoustic dampers so as to attenuate combustion dynamics within the combustor 26.

While the foregoing description relates generally to a gas turbine engine, the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A combustor for a gas turbine, the combustor including a combustor liner including an outer liner and an inner liner, a combustion chamber being defined between the outer liner and the inner liner, the combustion chamber including a primary combustion zone defined between the outer liner and the inner liner at an upstream end of the combustion chamber, an outer liner expanded primary volume portion, and a secondary outer liner portion, wherein one of the outer liner expanded primary volume portion and the secondary outer liner portion is movable to adjust a volume of the primary combustion zone by opening and closing access to the outer liner expanded primary volume portion so as to increase and to decrease the volume of the primary combustion zone.

The combustor according to the preceding clause, wherein the outer liner expanded primary volume portion functions as an acoustic damper.

The combustor according to any preceding clause, wherein the outer liner and the inner liner extend circumferentially about a combustor centerline axis, and the outer liner expanded primary volume portion comprises a plurality of expanded primary volume chambers circumferentially spaced about the combustor centerline axis.

The combustor according to any preceding clause, wherein the outer liner expanded primary volume portion is formed integral with the outer liner, and the secondary outer liner portion is movable, the secondary outer liner portion extending circumferentially about the combustor centerline axis, and extending in a longitudinal direction across an inner side of the outer liner expanded primary volume portion, the secondary outer liner portion including a plurality of secondary outer liner portion openings circumferentially spaced apart about the secondary outer liner portion, the secondary outer liner portion being rotationally actuated about the combustor centerline axis to rotate the plurality of secondary outer liner portion openings to open and to close access to the plurality of expanded primary volume chambers.

The combustor according to any preceding clause, wherein the outer liner expanded primary volume portion is movable, and the secondary outer liner portion is formed integral with the outer liner and includes a plurality of secondary outer liner portion openings therethrough in the primary combustion zone, the outer liner expanded primary volume portion including a plurality of expanded primary volume chambers circumferentially spaced about the combustor centerline axis, and the outer liner expanded primary volume portion being rotationally movable about the combustor centerline axis so as to open and to close access to the plurality of expanded primary volume chambers via the secondary outer liner portion openings.

The combustor according to any preceding clause, wherein the combustor further includes at least one main fuel nozzle and mixer assembly arranged at an upstream end of the combustion chamber, and at least one secondary fuel nozzle is included in the outer liner primary volume expansion portion.

The combustor according to any preceding clause, wherein each of the plurality of expanded primary volume chambers includes at least one cooling passage therethrough, and the secondary outer liner portion further includes a plurality of cooling passage engagement members that, when the secondary outer liner portion is rotated to a first position to open access to the plurality of expanded primary volume chambers, the plurality of cooling passage engagement members engage the at least one cooling passage to close the at least one cooling passage, and when the secondary outer liner portion is rotated to a second position to close access to the plurality of expanded primary volume chambers, the plurality of cooling passage engagement members disengage the at least one cooling passage to allow a cooling airflow to flow into the plurality of expanded primary volume chambers to provide impingement cooling to the secondary outer liner portion.

The combustor according to any preceding clause, wherein each of the plurality of expanded primary volume chambers includes a first side, a second side opposite the first side, and a radially outer side connected to the first side and to the second side, wherein the first side includes an airflow opening therethrough, the secondary outer liner portion further includes a plurality of airflow opening engagement members extending outward therefrom, respective ones of the plurality of airflow opening engagement members being arranged to engage with a respective one of the airflow openings, and, when the secondary outer liner portion is rotated to a first position to open access to the plurality of expanded primary volume chambers, respective ones of the airflow opening engagement members engage to close the respective ones of the airflow openings, and, when the secondary outer liner portion is rotated to a second position to close access to the plurality of expanded primary volume chambers, the respective ones of the plurality of airflow opening engagement members disengage the respective ones of the airflow openings to allow a cooling airflow to flow into the plurality of expanded primary volume chambers to provide impingement cooling to the secondary outer liner portion.

The combustor according to any preceding clause, wherein the outer liner and the inner liner extend circumferentially about a combustor centerline axis, the outer liner expanded primary volume portion is integral with the outer liner, and the secondary outer liner portion is movable, the secondary outer liner portion being arranged within the outer liner expanded primary volume portion and including a first block portion having a plurality of first block sections circumferentially spaced apart about the combustor centerline axis, and a second block portion having a plurality of second block sections circumferentially spaced apart about the combustor centerline axis, the first block portion and the second block portion being rotationally actuated with respect to each other so as to open access to the outer liner expanded primary volume portion to increase and to decrease the volume of the primary combustion zone.

The combustor according to any preceding clause, wherein the second block portion is arranged to rotate about the combustor centerline axis, and the first block portion is fixedly connected within the combustor so as to not rotate about the combustor centerline axis.

The combustor according to any preceding clause, wherein the first block portion includes a first block portion circumferential wall extending circumferentially about the combustor centerline axis and having an upstream extension portion extending upstream in a longitudinal direction from an upstream side of the plurality of first block sections, the first block portion circumferential wall including a plurality of airflow openings through the upstream extension portion arranged circumferentially between each of the plurality of first block sections.

The combustor according to any preceding clause, wherein the outer liner expanded primary volume portion is integral with the outer liner, and the secondary outer liner portion is movable, the secondary outer liner portion extending circumferentially about a combustor centerline axis, and extending in a longitudinal direction across an inner side of the outer liner expanded primary volume portion, the secondary outer liner portion being actuated in the longitudinal direction so as to open and to close access to the outer liner expanded primary volume portion.

The combustor according to any preceding clause, wherein the combustor further includes a primary fuel nozzle and mixer assembly arranged at an upstream end of the combustion chamber, and at least one secondary fuel nozzle is included in the outer liner primary volume expansion portion.

The combustor according to any preceding clause, wherein the secondary outer liner portion functions as an acoustic damper.

The combustor according to any preceding clause, wherein the outer liner includes an outer liner dilution opening therethrough and a dilution fence arranged at a dilution zone of the combustion chamber to permit a flow of dilution air to flow into the combustion chamber.

The combustor according to any preceding clause, wherein an upstream end of the secondary outer liner portion includes an upstream wall extending radially outward therefrom and extending circumferentially about the combustor centerline axis.

The combustor according to any preceding clause, wherein, when the secondary outer liner portion is actuated in the longitudinal direction, the upstream wall progressively adjusts the volume of the primary combustion zone so as to progressively increase the volume of the primary combustion zone and to progressively decrease the volume of the primary combustion zone.

The combustor according to any preceding clause, wherein the outer liner expanded primary volume portion includes at least one cooling airflow opening on a downstream side thereof, the at least one cooling airflow opening providing a flow of cooling air into an expanded primary combustion zone cavity defined between the outer liner expanded primary volume portion, and the secondary outer liner portion.

The combustor according to any preceding clause, wherein the outer liner expanded primary volume portion defines a multi-chamber expanded primary volume portion including an upstream expanded primary volume chamber extending circumferentially about the combustor centerline axis, and a downstream expanded primary volume chamber extending circumferentially about the combustor centerline axis.

The combustor according to any preceding clause, wherein the secondary outer liner portion is actuated in the longitudinal direction to a first position so as to open access to the upstream expanded primary volume chamber and to close access to the downstream expanded primary volume chamber, and is further actuated in the longitudinal direction to a second position so as to open access to both the upstream expanded primary volume chamber and to the downstream expanded primary volume chamber.

Although the foregoing description is directed to some exemplary embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A combustor for a gas turbine, the combustor comprising:

a combustor liner including an outer liner and an inner liner, a combustion chamber being defined between the outer liner and the inner liner, the combustion chamber including a primary combustion zone defined between the outer liner and the inner liner at an upstream end of the combustion chamber;

an outer liner expanded primary volume portion extending circumferentially about a combustor centerline axis; and a secondary outer liner portion extending circumferentially about the combustor centerline axis, wherein the secondary outer liner portion is movable to adjust a volume of the primary combustion zone by opening and closing access to the outer liner expanded primary volume portion so as to increase and to decrease the volume of the primary combustion zone.

2. The combustor according to claim 1, wherein the outer liner expanded primary volume portion functions as an acoustic damper.

3. The combustor according to claim 1, wherein the outer liner and the inner liner extend circumferentially about a combustor centerline axis, and the outer liner expanded primary volume portion comprises a plurality of expanded primary volume chambers circumferentially spaced about the combustor centerline axis.

4. The combustor according to claim 3, wherein the outer liner expanded primary volume portion is formed integral with the outer liner, and the secondary outer liner portion is movable, the secondary outer liner portion extending circumferentially about the combustor centerline axis, and extending in a longitudinal direction across an inner side of the outer liner expanded primary volume portion, the secondary outer liner portion including a plurality of secondary outer liner portion openings circumferentially spaced apart about the secondary outer liner portion, the secondary outer liner portion being rotationally actuated about the combustor centerline axis to rotate the plurality of secondary outer liner portion openings to open and to close access to the plurality of expanded primary volume chambers.

5. The combustor according to claim 3, wherein the outer liner expanded primary volume portion is movable, and the secondary outer liner portion is formed integral with the outer liner and includes a plurality of secondary outer liner portion openings therethrough in the primary combustion zone, the outer liner expanded primary volume portion including a plurality of expanded primary volume chambers circumferentially spaced about the combustor centerline axis, and the outer liner expanded primary volume portion being rotationally movable about the combustor centerline axis so as to open and to close access to the plurality of expanded primary volume chambers via the secondary outer liner portion openings.

6. The combustor according to claim 4, wherein the combustor further includes at least one main fuel nozzle and mixer assembly arranged at an upstream end of the combustion chamber, and at least one secondary fuel nozzle is included in the outer liner primary volume expansion portion.

7. The combustor according to claim 4, wherein each of the plurality of expanded primary volume chambers includes at least one cooling passage therethrough, and the secondary outer liner portion further includes a plurality of cooling passage engagement members that, when the secondary outer liner portion is rotated to a first position to open access to the plurality of expanded primary volume chambers, the plurality of cooling passage engagement members engage the at least one cooling passage to close the at least one cooling passage, and when the secondary outer liner portion is rotated to a second position to close access to the plurality of expanded primary volume chambers, the plurality of cooling passage engagement members disengage the at least one cooling passage to allow a cooling airflow to flow into the plurality of expanded primary volume chambers to provide impingement cooling to the secondary outer liner portion.

8. The combustor according to claim 4, wherein each of the plurality of expanded primary volume chambers includes a first side, a second side opposite the first side, and a radially outer side connected to the first side and to the second side, wherein the first side includes an airflow opening therethrough, the secondary outer liner portion further includes a plurality of airflow opening engagement members extending outward therefrom, respective ones of the plurality of airflow opening engagement members being arranged to engage with a respective one of the airflow openings, and, when the secondary outer liner portion is rotated to a first position to open access to the plurality of expanded primary volume chambers, respective ones of the airflow opening engagement members engage to close the respective ones of the airflow openings, and, when the secondary outer liner portion is rotated to a second position to close access to the plurality of expanded primary volume chambers, the respective ones of the plurality of airflow opening engagement members disengage the respective ones of the airflow openings to allow a cooling airflow to flow into the plurality of expanded primary volume chambers to provide impingement cooling to the secondary outer liner portion.

9. The combustor according to claim 1, wherein the outer liner and the inner liner extend circumferentially about a combustor centerline axis, the outer liner expanded primary volume portion is integral with the outer liner, and the secondary outer liner portion is movable, the secondary outer liner portion being arranged within the outer liner expanded primary volume portion and including a first block portion having a plurality of first block sections circumferentially spaced apart about the combustor centerline axis, and a second block portion having a plurality of second block sections circumferentially spaced apart about the combustor centerline axis, the first block portion and the second block portion being rotationally actuated with respect to each other so as to open access to the outer liner expanded primary volume portion to increase and to decrease the volume of the primary combustion zone.

10. The combustor according to claim 9, wherein the second block portion is arranged to rotate about the combustor centerline axis, and the first block portion is fixedly connected within the combustor so as to not rotate about the combustor centerline axis.

11. The combustor according to claim 10, wherein the first block portion includes a first block portion circumferential wall extending circumferentially about the combustor centerline axis and having an upstream extension portion extending upstream in a longitudinal direction from an upstream side of the plurality of first block sections, the first block portion circumferential wall including a plurality of airflow openings through the upstream extension portion arranged circumferentially between each of the plurality of first block sections.

12. The combustor according to claim 1, wherein the outer liner expanded primary volume portion is integral with the outer liner, and the secondary outer liner portion extends in a longitudinal direction across an inner side of the outer liner expanded primary volume portion, the secondary outer liner portion being actuated in the longitudinal direction so as to open and to close access to the outer liner expanded primary volume portion.

13. The combustor according to claim 12, wherein the combustor further includes a primary fuel nozzle and mixer assembly arranged at an upstream end of the combustion chamber, and at least one secondary fuel nozzle is included in the outer liner primary volume expansion portion.

14. The combustor according to claim 12, wherein the secondary outer liner portion functions as an acoustic damper.

15. The combustor according to claim 12, wherein the outer liner includes an outer liner dilution opening therethrough and a dilution fence arranged at a dilution zone of the combustion chamber to permit a flow of dilution air to flow into the combustion chamber.

16. The combustor according to claim 12, wherein an upstream end of the secondary outer liner portion includes an upstream wall extending radially outward therefrom and extending circumferentially about the combustor centerline axis.

17. The combustor according to claim 16, wherein, when the secondary outer liner portion is actuated in the longitudinal direction, the upstream wall progressively adjusts the volume of the primary combustion zone so as to progressively increase the volume of the primary combustion zone and to progressively decrease the volume of the primary combustion zone.

18. The combustor according to claim 16, wherein the outer liner expanded primary volume portion includes at least one cooling airflow opening on a downstream side thereof, the at least one cooling airflow opening providing a flow of cooling air into an expanded primary combustion zone cavity defined between the outer liner expanded primary volume portion, and the secondary outer liner portion.

19. The combustor according to claim 12, wherein the outer liner expanded primary volume portion defines a multi-chamber expanded primary volume portion including an upstream expanded primary volume chamber extending circumferentially about the combustor centerline axis, and a downstream expanded primary volume chamber extending circumferentially about the combustor centerline axis.

20. The combustor according to claim 19, wherein the secondary outer liner portion is actuated in the longitudinal direction to a first position so as to open access to the upstream expanded primary volume chamber and to close access to the downstream expanded primary volume chamber, and is further actuated in the longitudinal direction to a second position so as to open access to both the upstream expanded primary volume chamber and to the downstream expanded primary volume chamber.

* * * * *